US007117708B2

(12) United States Patent
Yamano et al.

(10) Patent No.: US 7,117,708 B2
(45) Date of Patent: Oct. 10, 2006

(54) DIE SET FOR PRESS FORMING METAL SHEET AND PRESS FORMING METHOD OF METAL SHEET

(75) Inventors: Takayuki Yamano, Kakogawa (JP); Jiro Iwaya, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 238 days.

(21) Appl. No.: 10/790,755

(22) Filed: Mar. 3, 2004

(65) Prior Publication Data

US 2004/0244458 A1 Dec. 9, 2004

(30) Foreign Application Priority Data

Jun. 4, 2003 (JP) ..... 2003-159518

(51) Int. Cl.
*B21D 22/00* (2006.01)

(52) U.S. Cl. ..... 72/350; 72/347

(58) Field of Classification Search ..... 72/350, 72/351, 347, 701, 356, 348, 349, 389.1
See application file for complete search history.

(56) References Cited

U.S. PATENT DOCUMENTS

| | | | | |
|---|---|---|---|---|
| 2,157,354 | A * | 5/1939 | Sherman | 72/349 |
| 4,312,695 | A * | 1/1982 | Willis | 156/344 |
| 4,346,580 | A * | 8/1982 | Saunders | 72/344 |
| 4,373,368 | A * | 2/1983 | Heijting | 72/344 |
| 5,152,047 | A * | 10/1992 | Kojima et al. | 29/411 |
| 5,329,799 | A * | 7/1994 | Ito et al. | 72/340 |
| 5,544,517 | A * | 8/1996 | Shimizu | 72/349 |
| 5,647,242 | A * | 7/1997 | Saunders | 72/349 |
| 5,797,291 | A * | 8/1998 | Yamada | 72/344 |
| 6,089,072 | A * | 7/2000 | Fields | 72/379.4 |
| 6,196,043 | B1 * | 3/2001 | Ehardt | 72/350 |
| 2002/0083754 | A1 * | 7/2002 | Miyauchi et al. | 72/349 |

OTHER PUBLICATIONS

"Press Forming Relative Difficulty Handbook" Second Edition, 1997, (The Nikkan Kogyo Shimbun, LTD.), pp. 175-196, not translated.

"A Consideration about Dimension Accuracy of High-Tension Material (8th Report)",—study of punching technology for inducing overrun, Sep. 12, 2002, 2 pages, not translated.

* cited by examiner

*Primary Examiner*—Derris H. Banks
*Assistant Examiner*—Teresa M. Bonk
(74) *Attorney, Agent, or Firm*—Oblon, Spivak, McClelland, Maier & Neustadt, P.C.

(57) ABSTRACT

A die set for press forming a metal sheet is provided, which comprises: at least a punch; and a die, wherein a punch-die clearance CL2 corresponding to a site to be formed immediately after the initial stage of press forming and a punch-die clearance CL1 corresponding to a site to be formed in the initial stage of press forming are set so as to satisfy the following expressions (1) and (2), respectively:

$$0.8\times t \leqq CL1 \leqq 1.2\times t \quad (1)$$

$$CL2 \geqq CL1+t \quad (2)$$

where t denotes the thickness of the metal sheet to be formed. This configuration implements a die set for press forming capable of stably generating the reverse bending deformed portion due to overrun even when the die radius is large, minimizing the phenomenon such as wall warp, and enhancing the dimensional accuracy in press forming of a metal sheet, and a press forming method using the die set.

8 Claims, 21 Drawing Sheets

TARGET SHAPE
(SHAPE AT FORMING BOTTOM DEAD CENTER)

SHAPE AFTER FORMING
(SHAPE AFTER RELEASE FROM DIE)

DIE SET FOR PRESS FORMING METAL SHEET AND PRESS FORMING METHOD OF METAL SHEET

BACKGROUND OF THE INVENTION

1. Field of the Invention

The present invention relates to a die set for press forming a metal sheet such as a sheet steel or an aluminum sheet mainly applicable to an automobile body, and a press forming method using such a die set. More particularly, it relates to a die set for press forming and a press forming method, each capable of minimizing the occurrence of dimensional accuracy defect of a formed product caused by elastic recovery after release from the die set in press forming.

2. Description of Related Art

In the motor vehicle related industry, high strength materials tend to be increasingly used because of a growing demand for an improvement of the crash safety of an automobile body and environmental protection (improvement of fuel economy due to a reduction in weight). A large number of parts of an automobile body are generally manufactured by press forming metal sheets. However, when these parts are formed by press forming, the shape (dimension) of the resulting formed product varies from the designed value due to the elastic recovery behavior after release from the die set (taking out from the die set after forming), which may cause deficiencies at the time of assembling of parts or at the time of bonding (often, bonding by spot welding). Such deficiencies are generically referred to as dimensional accuracy defects. As such dimensional accuracy defects, various ones such as wall warp and angle change are known (see, e.g., "Press Forming Relative Difficulty Handbook" second edition (1997), pages 175 to 196, THE NIKKAN KOGYO SHIMBUN, LTD.).

In recent years, with the growing opportunities to use a sheet steel having higher strength, and an aluminum sheet having a smaller weight than that of a sheet steel, but having a low Young's modulus for an automobile body from the viewpoints of a reduction in weight and the stability of the automobile body, the foregoing dimensional accuracy defect has become a noticeable problem.

FIG. 1 is an explanatory diagram showing an outside shape example of a hat channel member as an automotive part. Such a hat channel member is mainly formed by a draw forming method [FIG. 2A] and a bend forming method [FIG. 2B].

One example of the dimensional accuracy defect when a hat channel member was formed using a die set (a die set for draw forming) shown in FIG. 2A will be described by reference to FIGS. 3A and 3B. FIGS. 3A and 3B each show a product cross sectional shape when a 980 MPa class cold rolled sheet steel (thickness t: 1.2 mm) has been formed. It is indicated that the shape after press forming [FIG. 3B] largely deviates from the objective dimensions. Namely, when the designed (objective) shape (axially perpendicular cross sectional shape) of the hat channel member is assumed to be the one shown in FIG. 3A, the flange surface to be bonded to other parts by spot welding or the like, and to be required to have a close dimensional accuracy springs up by as much as 48° (this spring up angle will be referred to as a "flange spring angle θ", below). This is considered to be caused by the effects of both the angle change defect at a punch shoulder and the wall warp defect at a sidewall portion [FIG. 3B]

It is explained that the occurrence mechanism of the wall warp arising at the sidewall portion of the hat channel member is due to the following mechanisms (1) to (3) (see the aforesaid document).

(1) The material (metal sheet) undergoes bending deformation when passing through the die radius portion;

(2) When this portion flows from the die radius portion to the sidewall portion, it undergoes bending-back deformation to be stretched in a straight line, and at this step, a difference between stresses of opposite signs occurs along the sheet thickness direction at the sidewall portion, so that the bending moment due to the difference in stress inherently exists; and (3) When the resulting formed product is released from the die set after forming, elastic recovery is generated so as to release the bending moment, and as a result, warp occurs.

As techniques for reducing such a wall warp phenomenon, various proposals have been made heretofore. As one of such techniques, there is known a method utilizing the reverse bending in a die gap (between a die and a punch (see, the Non-patent Document 1)). The mechanism for wall warp reduction in the case where this method is applied is described as follows.

First, as with general forming, when a material passes through the die radius portion, it undergoes bending deformation. However, when this portion flows from the die radius portion to the sidewall portion, there may occur a phenomenon that the material does not completely wind around the die radius portion according to setting of the size of the die radius and the clearance (the gap between the punch and the die). This phenomenon is generally referred to as overrun. The material which has flown to the sidewall portion due to this phenomenon undergoes bending in a reverse direction to the foregoing bending direction (generally referred to as reverse bending).

Then, when the material is released from the die set after forming, elastic recovery occurs so as to release the bending moment as with general forming. However, the elastic recovery at this step acts in a direction to cancel out the foregoing resultant reverse bending. For this reason, when the curvature of reverse bending and the curvature generated due to elastic recovery become equal to each other, these cancel out each other. As a result, it becomes possible to set the curvature of the sidewall portion (=wall warp) to 0.

As a method for controlling the wall warp by utilizing the overrun, there is conventionally known a method in which the die radius and the clearance are properly controlled. However, with such a technique, the die radius and the clearance are required to be controlled accurately in order to entirely eliminate the wall warp. Particularly, the technique will not exert its effects unless the die radius (rd) is controlled at rd/t (t: thickness)=about 1.5 (see the aforesaid document) The thickness t of the sheet steel generally used for automotive structural parts is about 1 mm. Thus, in order for the technique to effectively exert its effects, it is essential that the die radius (rd) is set at about 1.5 mm.

However, when the die radius (rd) is reduced, unfavorably, the risk of the occurrence of cracking during forming increases so much, and tools become more likely to wear, which necessitates the maintenance of the tools to be frequently performed. These problems can also be said to be destabilizing factors in actual production. For this reason, the foregoing method is unfavorably less applicable to mass production.

SUMMARY OF THE INVENTION

Under such circumstances, the present invention has been completed. It is therefore an object of the present invention to implement a die set for press forming capable of stably generating a reverse bending deformed portion due to overrun even when a die radius is large, minimizing the phenomenon such as wall warp, and enhancing dimensional accuracy in press forming of a metal sheet, and a press forming method using the die set.

A die set for press forming a metal sheet according to one aspect of the present invention, capable of achieving the foregoing object, is a die set for press forming a metal sheet, which comprises: at least a punch; and a die, characterized in that a clearance CL2 between the punch and the die corresponding to a site to be formed immediately after an initial stage of press forming is at least set wider than a clearance CL1 between the punch and the die corresponding to a site to be formed in the initial stage of-press forming (CL1<CL2).

In the die set, the clearances CL1 and CL2 are set so as to satisfy the following expressions (1) and (2), respectively:

$$0.8\times t \leqq CL1 \leqq 1.2\times t \quad (1)$$

$$CL2 \geqq CL1+t \quad (2)$$

where t denotes a thickness of the metal sheet to be formed.

The die set of the present invention is additionally configured as follows. The die set for press forming a metal sheet further comprises a forming jig which moves in synchronism with the die while keeping the relative position to the die during forming, and forms the vertical wall portion of the metal sheet, wherein in the forming jig, a clearance CL4 between the forming jig and the die in the vicinity of a die shoulder is set so as to be wider than a clearance CL3 between the forming jig and the die in the forming area other than the vicinity of the die shoulder (CL3<CL4). As a result, it is possible to further enhance the dimensional accuracy for press forming of a metal sheet.

Whereas, in such a die set, it is preferable that the clearances CL3 and CL4 are set so as to satisfy the following expressions (3) and (4), respectively:

$$0.8\times t \leqq CL3 \leqq 1.2\times t \quad (3)$$

$$CL4 \geqq CL3+t \quad (4)$$

where t denotes the thickness of the metal sheet to be formed.

Further, even when the die set of the present invention is configured such as not to have the clearances CL1 and CL2 provided, and have only the clearances CL3 and CL4, if required, it is possible to achieve the object of the present invention. Namely, in accordance with another aspect of the present invention, a die set comprising at least a punch and a die, for press forming a metal sheet, and thereby manufacturing a formed product having an inclined vertical wall portion, comprises a forming jig which moves in synchronism with the die while keeping the relative position to the die during forming, and forms the inclined vertical wall portion of the metal sheet, characterized in that in the forming jig, a clearance CL4 between the forming jig and the die in the vicinity of the die shoulder is set so as to be wider than a clearance CL3 between the forming jig and the die in the forming area other than the vicinity of the die shoulder (CL3<CL4).

Even when such a die set configuration is adopted, the clearances CL3 and CL4 are preferably set so as to satisfy the expressions (3) and (4), respectively.

By press forming metal sheets by means of the foregoing various die sets for press forming, it is possible to obtain metal press formed products excellent in dimensional accuracy without causing disadvantages such as wall warp and angle change.

The present invention is constituted as described above. It is possible to implement a die set for press forming capable of stably generating overrun even when the die radius rd is large, minimizing the phenomenon such as wall warp or angle change, and enhancing the dimensional accuracy in press forming of the metal sheet, and a press forming method using the die set.

DETAILED DESCRIPTION OF THE PREFERRED EMBODIMENTS

The present inventors have conducted a study from various angles to solve the foregoing problems. Then, they have first acquired the following idea. In order to effectively induce the formation of the reverse bending deformed portion due to overrun even when the die radius (rd) portion is a large area, it is essential only to implement the form of a die set having a space where a material which has passed through the die shoulder, and flown to the vertical wall (sidewall) can be largely deformed between tools (between a die and a punch) during forming or during release from the die set. Thus, they further conducted a study based on such an idea, and then, they found that the foregoing object could be fairly implemented by adopting the foregoing constitution. As a result, they completed the present invention.

Figure 1:
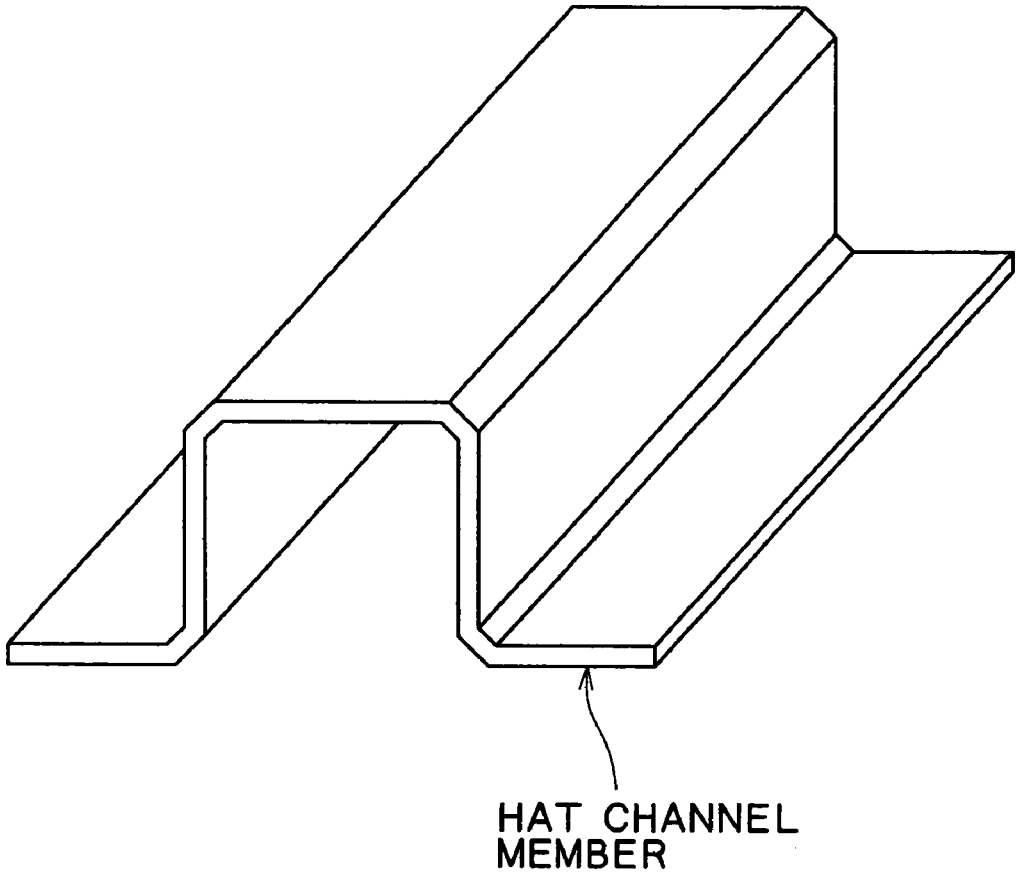
FIG. 1 is an explanatory diagram showing an outside shape example of a hat channel member.
Figure 2A:
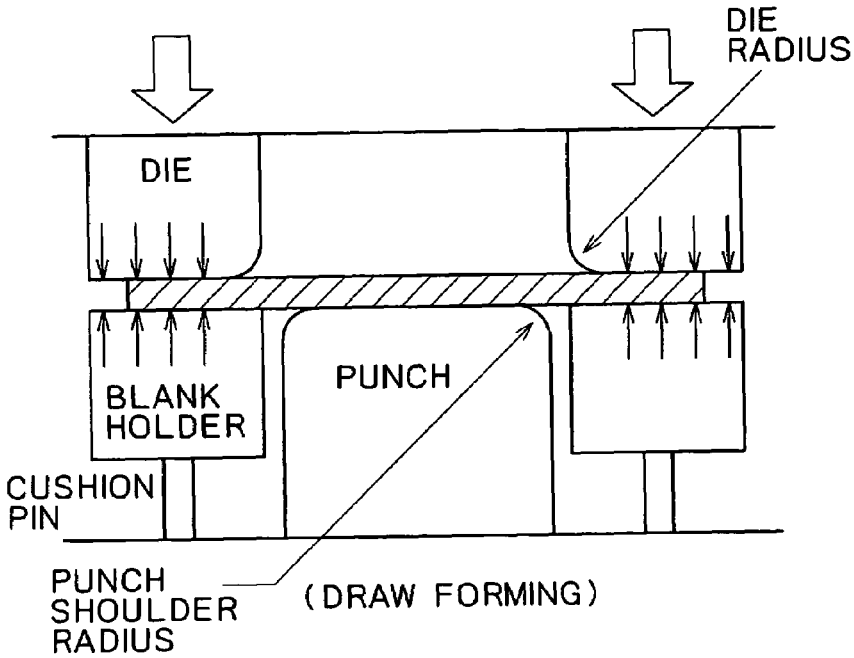
FIGS. 2A and 2B are schematic explanatory diagrams each showing a main forming method of the hat channel member.
Figure 2B:
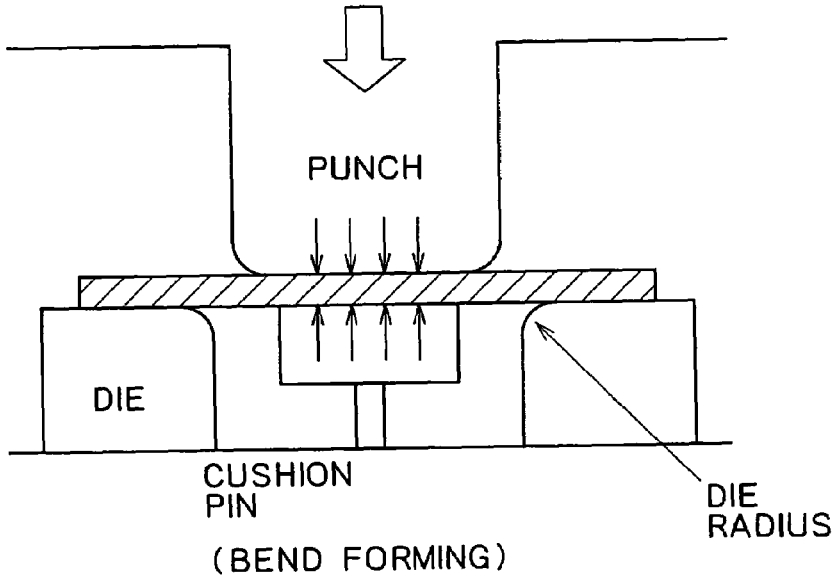

The constitution, and the function and effects of the present invention will be described by reference to the accompanying drawings. Incidentally, in the following explanation, for convenience of description, explanation will be given by citing the case where hat channel members often used for the parts of the automobile body are draw formed as members to be press formed. The members to be formed in the present invention are not certainly limited to such hat channel members. Further, the forming method thereof is also not limited to the draw forming method. For example, other members and forming methods are also applicable by changing the shape of a punch in bend forming (forming) as shown in FIG. 2B.

Figure 4:
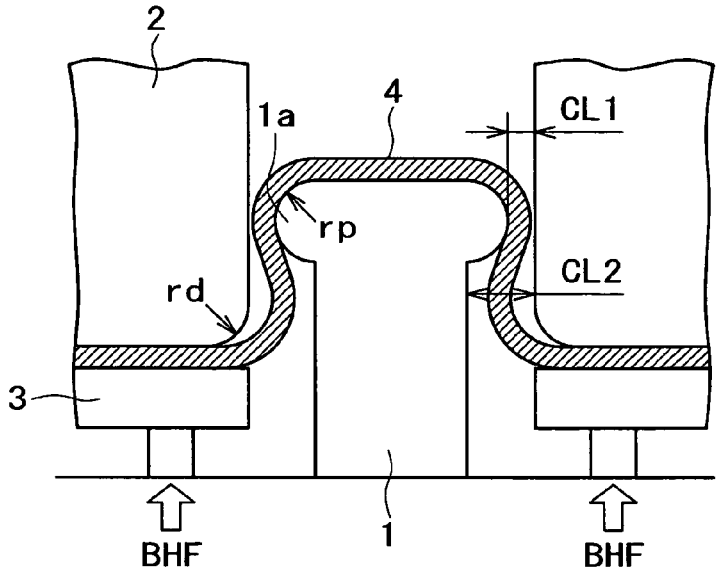
FIG. 4 is a schematic explanatory diagram showing one example of a configuration of a press forming die set of the present invention.

FIG. 4 is a schematic explanatory diagram showing one example of a configuration of a press forming die set of the present invention. In the diagram, a reference numeral 1 denotes a punch; 2, a die; 3, a blank holder; 4, a metal sheet; rd, the die radius; rp, the punch shoulder radius; and BHF, a blank holding force. For the die set of the present invention, as shown in FIG. 4, at least a punch-die clearance CL2 corresponding to the site (the lower part of the punch 1 shown in FIG. 4) to be formed immediately after the initial stage of forming is set wider than a punch-die clearance CL1 corresponding to the site (the upper part of the punch 1 shown in FIG. 4) to be formed at the initial stage of forming (CL1<CL2). Namely, with the press forming die set of the present invention, a convex portion 1*a* extending along the die is formed at the top part area of the punch 1 corresponding to the site to be formed at the initial stage of forming so that the clearances CL1 and CL2 satisfy the foregoing relationship. Incidentally, the term "initial stage of forming" denotes the period from the start of press forming of the metal sheet 4 until a given time elapses.

Figure 5A:
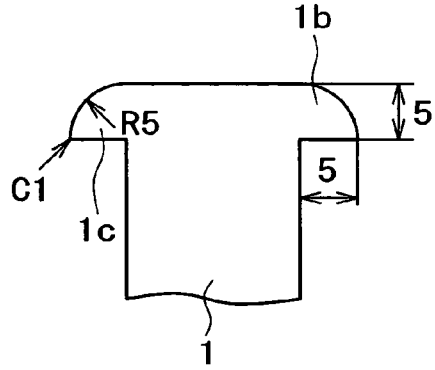
FIGS. 5A and 5B are schematic explanatory diagrams showing various shapes of the die sets of the present invention.
Figure 5B:
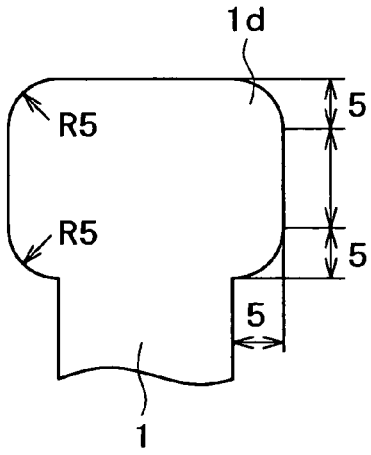

With the configuration shown in FIG. 4, the convex portion 1*a* is formed of the curved surface. However, the present invention is not limited to such a configuration. The punches 1 of various shapes such as the punch 1 mushroom shaped in cross section, having a planar portion 1*c* at a part of the convex portion 1*b* as shown in FIG. 5A, and the punch 1 having an elongated length along the direction of axis of a convex portion 1*d* (i.e., whereby the time of the initial stage of forming is elongated) as shown in FIG. 5B are adoptable. Incidentally, "R5" in FIGS. 5A and 5B denotes the punch shoulder radius rp (or the radius of the top curved surface of the convex portion 1*d*) set at 5 mm.

Any configuration of the die set of the present invention allows its effects to be achieved so long as the clearances CL1 and CL2 satisfy the foregoing relationship. The configurations are not limited to those shown in FIGS. 4 and 5. The object of the present invention is achieved even by the die sets of the following configurations: for example, a die set configured such that the clearance CL2 gradually widens from the site to be formed at the initial stage of forming through the site to be subsequently formed; and another die set configured such that the clearance CL2 is once widened immediately after the initial stage of forming, and then further narrowed so as to approach the clearance CL1. In short, it is essential only that at least the punch-die clearance CL2 corresponding to the site to be formed immediately after the initial stage of press forming and the punch-die clearance CL1 corresponding to the site to be formed at the initial stage of press forming satisfy the foregoing relationship.

The clearances CL1 and CL2 are conceivably set in various combinations. Generally, even when any combination was adopted, the obtained result was that the dimensional accuracy was improved than with the use of a conventional die. The present inventors conducted a study on the combination of CL1 and CL2 which most improves the dimensional accuracy.

The present inventors carried out an examination on the dimensional accuracy when a hat channel member was formed with press forming by means of the die set (rp=5 mm) of the present invention shown in FIG. 4 using a 980 MPa class cold rolled sheet steel (thickness t: 1.2 mm) in relation to the clearances CL1 and CL2. At this step, the clearance CL1 was set at three values of (1) t+0.4 mm, (2)

t+0.2 mm, and (3) t mm. Whereas, the clearance CL2 was set at CL1+5 mm as a sufficiently large value. Further, other conditions were set as follows. Whereas, at this step, an examination was also carried out on the case where press forming (draw forming) was performed using a conventional die set shown in FIG. 2A (Clearances: t+0.2 mm, t+0.4 mm, t+0.6 mm, and t+0.8 mm).

(Press Forming Conditions)

Die radius (rd): 5 mm

Forming height H (FIG. 10): 67 mm

Blank size: width 250 mm, depth 40 mm

Figure 3A:
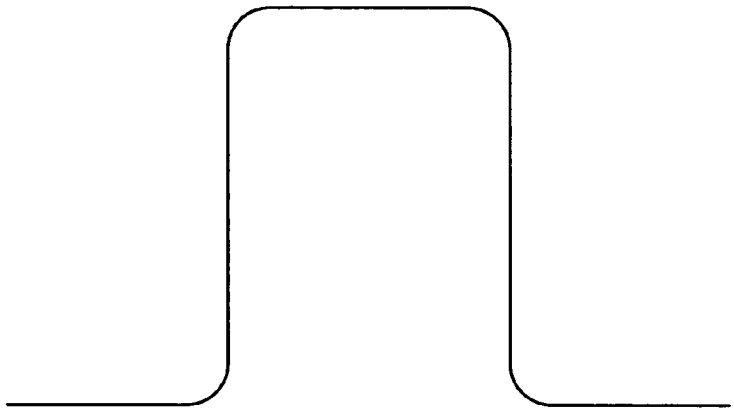
FIGS. 3A and 3B are diagrams for illustrating one example of dimensional accuracy defects.
Figure 3B:
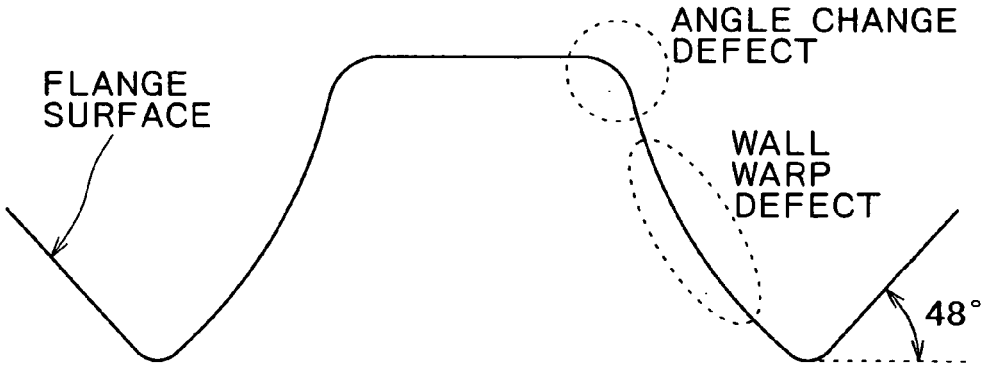
Figure 6A:
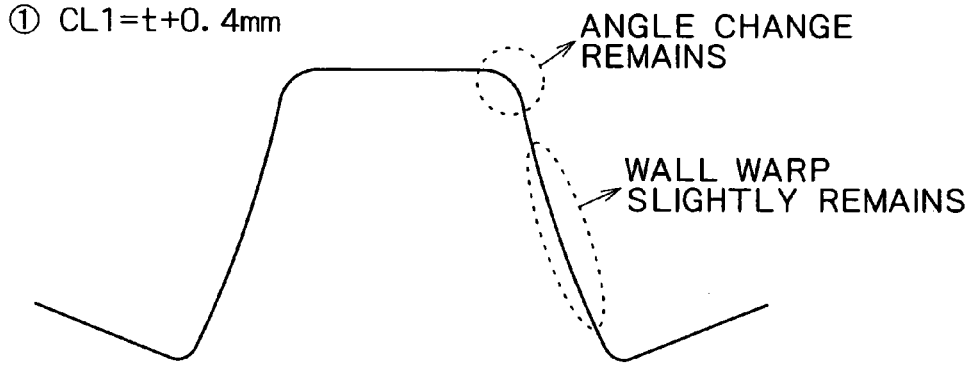
FIGS. 6A to 6C are schematic explanatory diagrams showing the product cross sectional shapes when press forming has been performed under the conditions of various clearances CL1.
Figure 6B:
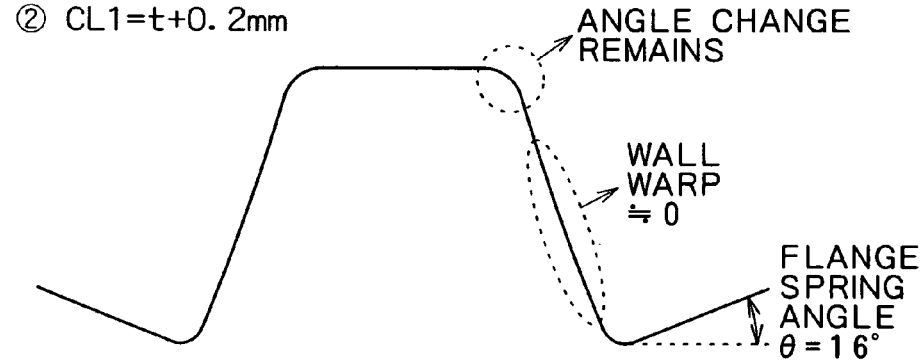
Figure 6C:
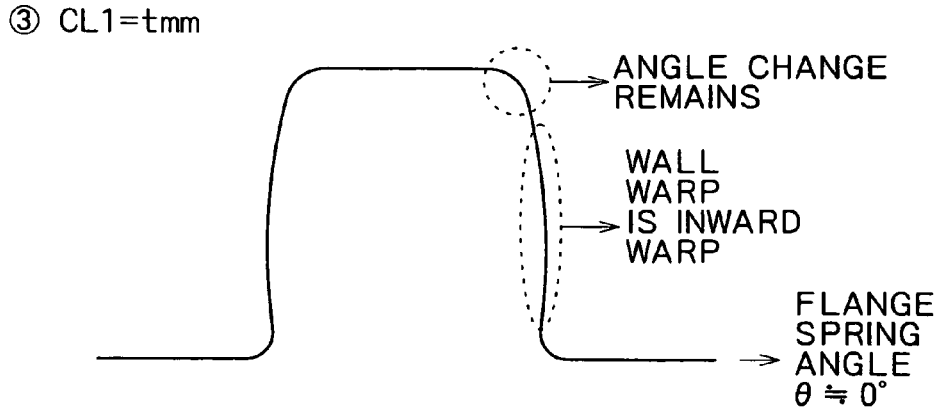

The cross sectional shapes when press forming was carried out under respective conditions are shown in FIGS. 6A to 6C. Incidentally, when press forming was performed using the conventional die set shown in FIG. 2A (conventional forming), there was no difference in amount of dimensional accuracy defect such as "wall warp" according to the clearances. However, the cross sectional shape at a clearance of t+0.8 mm is as shown in FIG. 3B, where both of the wall warp and the angle change occur, and the flange spring angle θ shows a value as large as 48°.

On the other hand, FIG. 6A shows the cross sectional shape for the clearance CL1 set at (t+0.4 mm), and shows the situation where the dimensional accuracy has been improved largely than with conventional forming, but "wall warp" slightly remains. However, for the clearance CL1 set at (t+0.2 mm) [FIG. 6B], the effects of wall warp and reverse warp cancel out each other, which allows "wall warp" ≈0. However, in this case, the situation has been such that flange spring caused by the angle change defect at the punch shoulder portion still remains.

Further, for the clearance CL1 reduced to t (corresponding to the sheet thickness), the effect of overrun is intensively produced, so that the sidewall portion is inwardly warped [FIG. 6C]. The inward warp and the angle change at the punch shoulder cancel out each other, which can implement a flange spring angle θ=0°. Incidentally, the shape of the sidewall portion in this case is an inwardly warped shape, and hence it is different from the target shape.

These results indicate the following consideration. Namely, depending upon whether importance is attached to the shape of the sidewall portion or importance is attached to the spring of the flange surface, the clearance CL1 is finely controlled within a range of t≦CL1≦t+0.2 (mm). As a result, optimum dimensional accuracy can be obtained.

The present inventors also carried out an examination on some materials for the effect of the clearance CL1 by changing the clearance CL1 within a range of 0.8 t to 2.0 t. The conditions other than the kind of the material and the sheet thickness t at this step are the same as described above (therefore, clearance CL2=CL1+5 mm). The results are shown in Table 1, which indicates as follows. For all the materials, optimum dimensional accuracy is obtained by controlling the clearance CL1 within a range of 0.8×t≦CL1≦1.2×t. Incidentally, the reason why the lower limit of the clearance CL1 is set at 0.8×t is as follows. When the clearance CL1 becomes narrower than this, the sheet thickness becomes too thin, which may reduce the strength characteristic as the member.

TABLE 1

| Material | Evaluation item | Clearance CL1 | | | | |
|---|---|---|---|---|---|---|
| | | 0.8 × t | 1.0 × t | 1.2 × t | 1.4 × t | 1.6 × t or more |
| 5000 series aluminum sheet (t: 1.0 mm) | Wall warp curvature | ◎ | ◎ | ○ | ○ | Δ |
| | Flange spring angle | ◎ | ◎ | ○ | ○ | Δ |
| Pure titanium sheet JIS Class 1 (t: 1.0 mm) | Wall warp curvature | ◎ | ◎ | ○ | ○ | Δ |
| | Flange spring angle | ◎ | ◎ | ○ | ○ | Δ |
| 440 MPa cold rolled sheet steel (t: 1.2 mm) | Wall warp curvature | ◎ | ◎ | ○ | ○ | Δ |
| | Flange spring angle | ◎ | ◎ | ○ | ○ | Δ |
| 590 MPa cold rolled sheet steel (t: 1.2 mm) | Wall warp curvature | ◎ | ○ | ◎ | ○ | Δ |
| | Flange spring angle | ◎ | ◎ | ○ | ○ | Δ |
| 980 MPa cold rolled sheet steel (t:1.0 mm) | Wall warp curvature | ○ | ○ | ◎ | ○ | Δ |
| | Flange spring angle | ○ | ◎ | ○ | ○ | Δ |
| 980 MPa cold rolled sheet steel (t: 1.2 mm) | Wall warp curvature | ○ | ○ | ◎ | ○ | Δ |
| | Flange spring angle | ○ | ◎ | ○ | ○ | Δ |
| 980 MPa cold rolled sheet steel (t: 1.4 mm) | Wall warp curvature | ○ | ○ | ◎ | ○ | Δ |
| | Flange spring angle | ○ | ◎ | ○ | ○ | Δ |
| 980 MPa cold rolled sheet steel (t: 1.6 mm) | Wall warp curvature | ○ | ○ | ◎ | ○ | Δ |
| | Flange spring angle | ○ | ◎ | ○ | ○ | Δ |

◎: Conditions under which the defective forming amount is less than 10% of that for conventional forming;
○: Conditions under which the defective forming amount is 10% or more and less than 50% of that for conventional forming;
Δ: Conditions under which the defective forming amount is 50% or more and less than 100% of that for conventional forming; and
X: Conditions under which the defective forming amount is equal to or more than that for conventional forming.

Incidentally, when the die set shown in FIG. 4 is used, and the clearance CL1 is set at (t+0.2 mm), as shown in FIG. 6B, the situation is such that "wall warp" ≈0 has been implemented, but the spring of the flange still remains. Consequently, the present inventors also studied the method capable of minimizing the flange spring angle θ while implementing "wall warp" ≈0.

Figure 7:
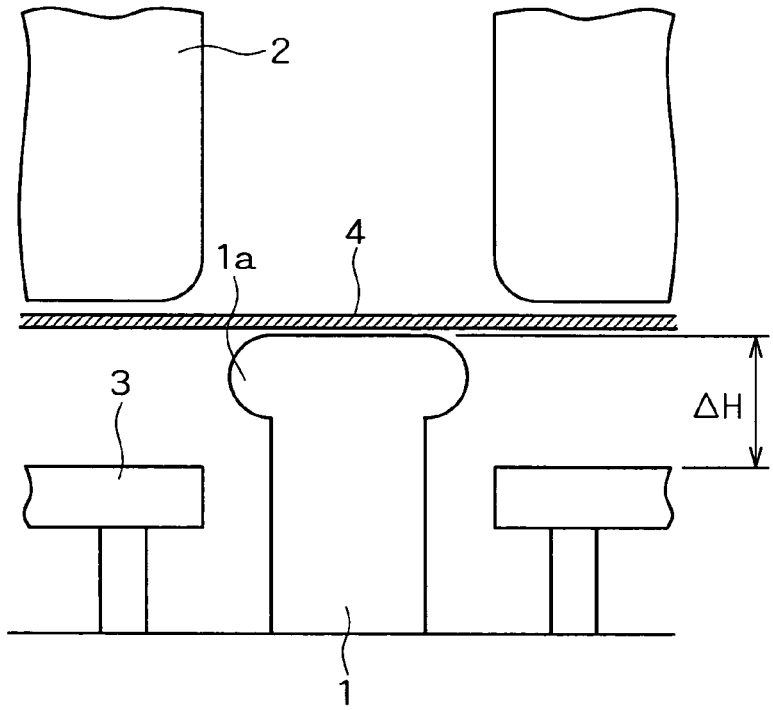
FIG. 7 is a diagram for illustrating the state in which forming is started with a blank holder waiting.

As a result, it has also been found as follows. As shown in FIG. 7, the blank holder 3 is allowed to wait at a position lower than the top surface of the punch 1 at the time of start of forming (in the diagram, ΔH denotes the wait height). This can minimize the flange spring angle θ. Namely, in general, with conventional press forming, first, the metal sheet 4 is interposed and held between the die 2 and the blank holder 3, and then forming is started (for this procedure, see FIGS. 9A and 9B). The blank holder 3 is set in the state shown in FIG. 7 at this time of start of forming, and then forming is started, which implements the reduction in punch shoulder angle change. As a result, it is possible to minimize the flange spring angle θ. Therefore, for carrying out press forming using the die set of the present invention, the clearance CL1 is set within a proper range to implement "wall warp" ≈0, and the wait height ΔH shown in FIG. 7 is appropriately set to reduce the angle change. As a result, it is possible to obtain a press formed product more excellent in dimensional accuracy.

Figure 8:
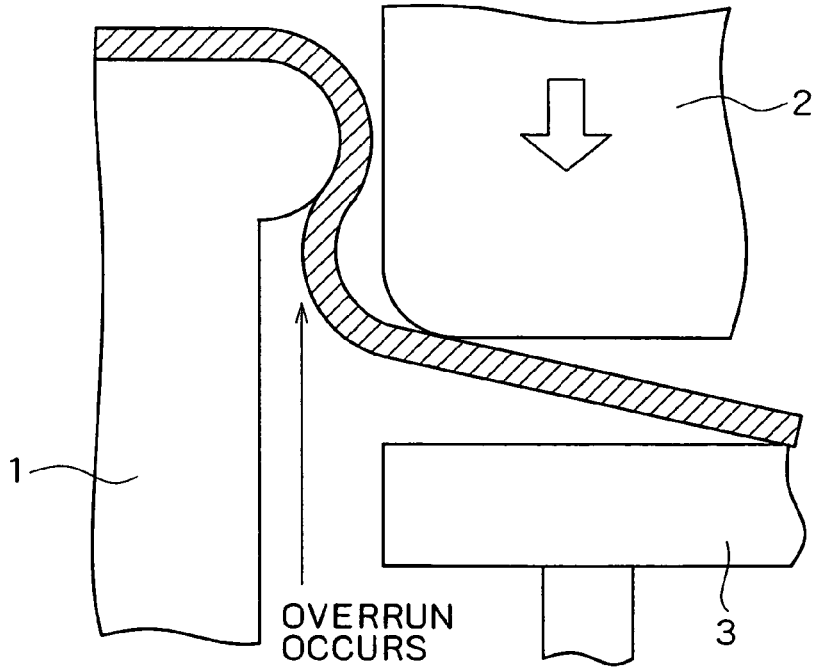
FIG. 8 is a diagram for illustrating the conditions of occurrence of overrun when forming has been performed with the blank holder waiting.

The reason why the foregoing effect can be obtained by starting press forming in the state shown in FIG. 7 is conceivable as follows. Namely, when the blank holder 3 is allowed to wait at a position lower than the punch top surface at the time of start of forming, bend forming by the punch 1 and the die 2 acts on the metal sheet 4 during the initial stage of forming until the blank holder 3 and the die 2 approach each other. During the bend forming, material restraint due to holding by the blank holder 3 does not work. Therefore, as shown in FIG. 8 (partially enlarged diagram), overrun becomes more likely to occur. For this reason, the material (metal sheet 4) becomes likely to wind over a wide range of the punch shoulder (i.e., the bending angle of the metal sheet 4 becomes larger than 90°). Thus, the bending angle approaches 90° close to ideal by spring back after release from the die set.

By the completion of the die set of the foregoing configuration, it was possible to implement the improvement of the dimensional accuracy. However, it was clarified as follows. The factor affecting the dimensional accuracy is not only overrun during forming. However, the amplification of overrun upon release from the die set and reverse bending upon passing the punch shoulder portion (e.g., the convex portion 1*a* of FIG. 4) also affect the dimensional accuracy. Such a situation will be described by reference to the drawings.

Figure 9A:
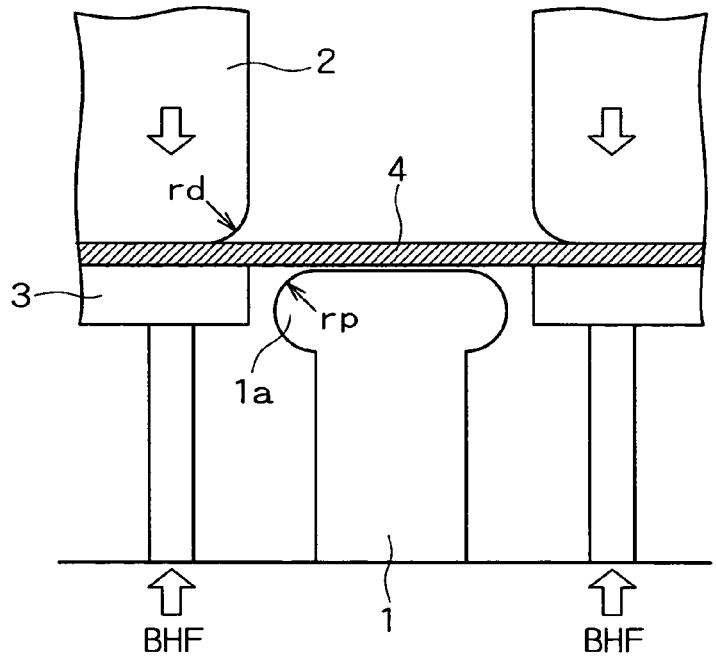
FIGS. 9A and 9B are explanatory diagrams each showing the state of the die set at the time of start of forming.
Figure 9B:
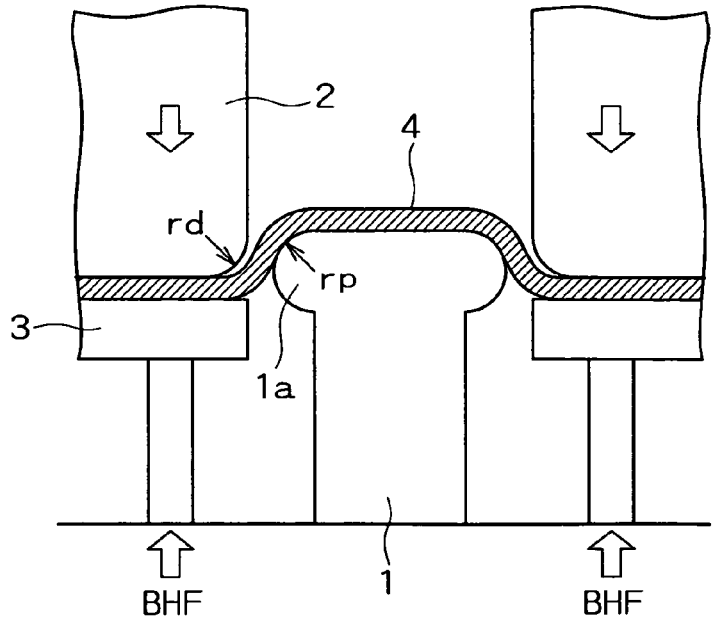

FIGS. 9A and 9B are explanatory diagrams each showing the state of the die set at the time of start of forming. First, as shown in FIG. 9A, the metal sheet 4 is interposed and held between the die 2 and the blank holder 3, so that the top end of the punch 1 is being in contact with the surface of the metal sheet 4. Then, the die 2 is caused to move downward with the metal sheet 4 interposed between the die 2 and the blank holder 3, so that forming of the metal sheet 4 is started by the operation of the punch 1 [FIG. 9B]. The die 2 keeps moving downward, thereby to perform forming.

Figure 10:
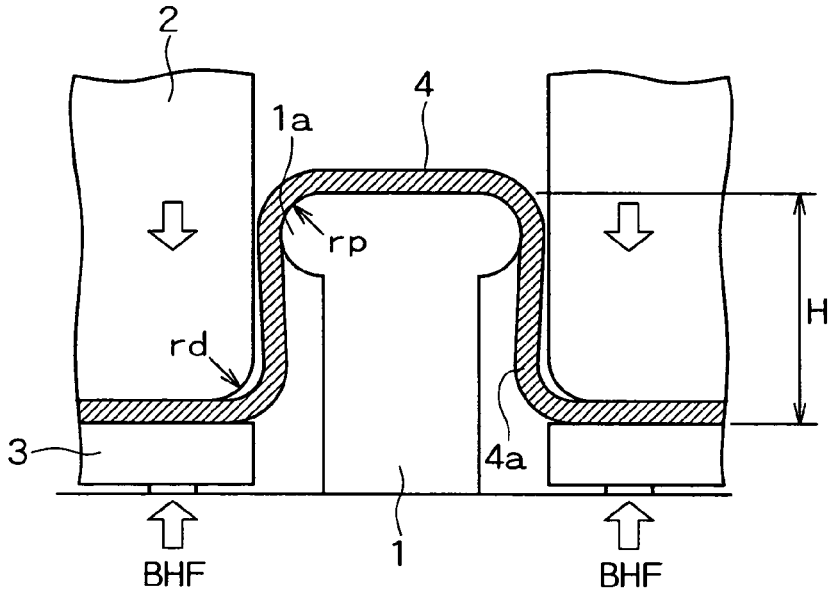
FIG. 10 is an explanatory diagram showing the state in which forming of a metal sheet has been completed (forming bottom dead center)

FIG. 10 is an explanatory diagram showing the state in which forming of the metal sheet 4 has been completed (forming bottom dead center). In this state, the blank holder 3 has gone downward completely, and the forming of the vertical wall portion of the metal sheet 4 has completely undergone forming (in the diagram, H denotes the forming height). Then, in this state, overrun occurs at the vertical wall lower part 4*a* of the metal sheet 4.

Figure 11:
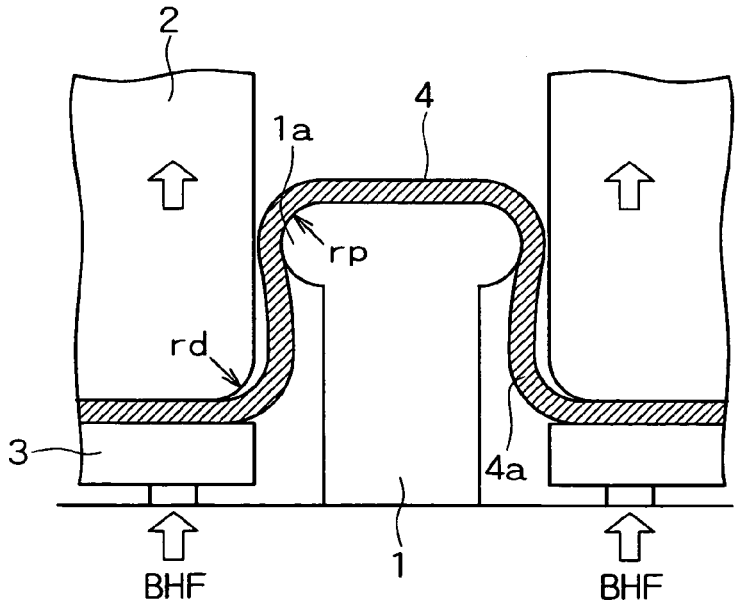
FIG. 11 is a diagram for illustrating the state in which the overrun caused to the metal sheet is further amplified.
Figure 12A:
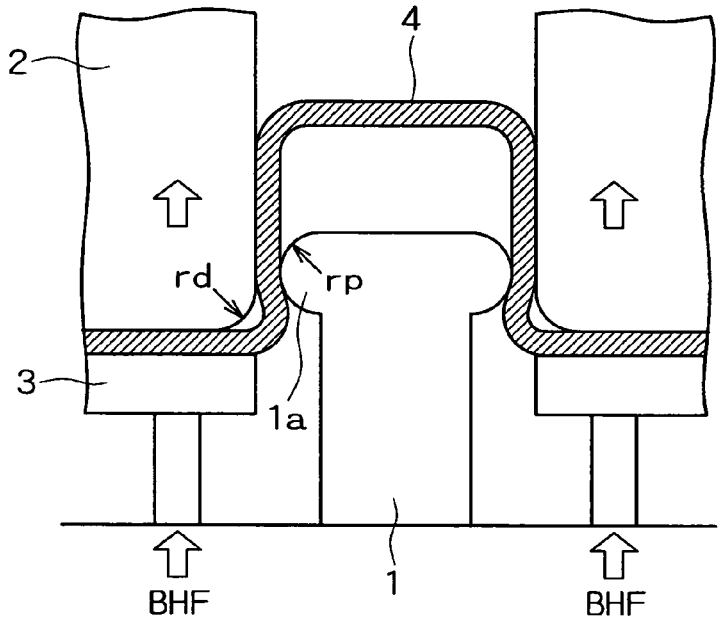
FIGS. 12A and 12B are diagrams for illustrating the state in which reverse bending occurs in the lower part 4*a* of the metal sheet 4.

Subsequently, the die 2 is caused to move upward with the metal sheet 4, which has completely undergone forming, interposed between the die 2 and the blank holder 3 for release. As a result, as shown in FIG. 11, the narrow clearance at the punch shoulder portion (convex portion 1*a*) results in resistance to release, the overrun occurred at the vertical wall lower part 4*a* of the metal sheet 4 is further amplified. Then, the die 2 further keeps moving upward (being released), so that as shown in FIG. 12A, reverse bending occurs at the vertical wall lower part 4*a* when the vertical wall lower part 4*a* passes the vicinity of the punch shoulder portion (convex portion 1*a*). For the member which has undergone the step of [FIG. 12B] and has been completely released from the die set, the wall warp of the vertical wall portion is improved by this effect of reverse bending. Namely, as shown in FIGS. 6B and 6C, by the control of reverse bending, it is possible to entirely eliminate the wall warp, or to cause the wall to tend to undergo inward warp.

Figure 12B:
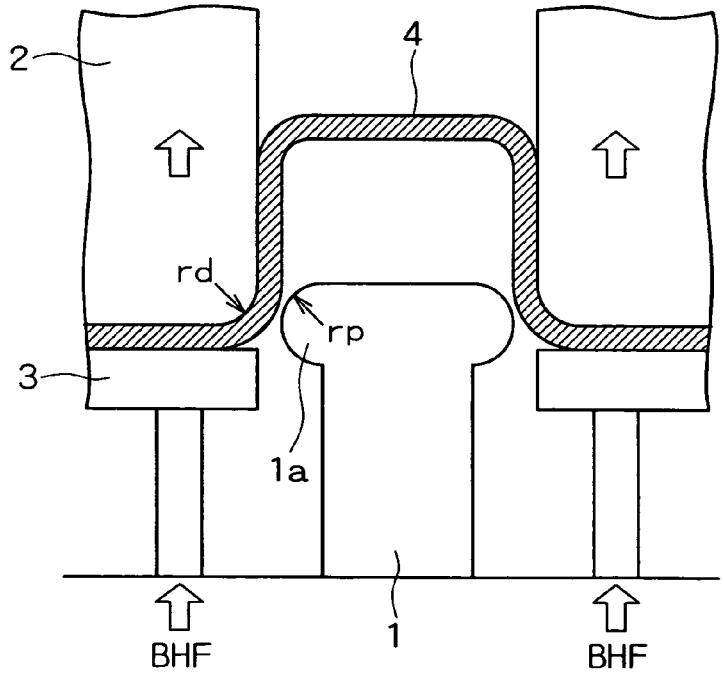
Figure 13:
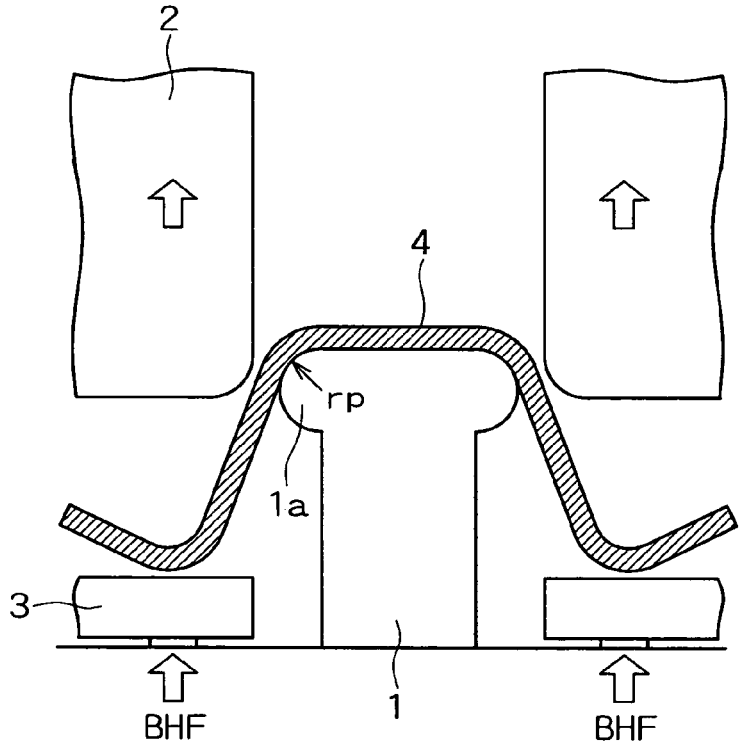
FIG. 13 is a diagram for illustrating the state of the metal sheet when removed from the die set with a blank holder locked at the bottom dead center.

For the release from the die set shown in FIGS. 11 and 12A and 12B, there is shown the case where upon upward movement of the die 2, the blank holder 3 follows it, and also moves upward [the result shown in FIG. 6 is also intended for this case]. However, there is also another case of forming where the blank holder 3 is locked at the forming bottom dead center during release from the die set, and does not move upward together with the die 2 during release from the die set. There are relatively few cases where forming is performed with the blank holder 3 locked at the bottom dead center during release from the die set from the viewpoint of the productivity of press forming. When the release is carried out with the blank holder 3 locked at the bottom dead center, the metal sheet 4 is released from the die set, and comes in the wall warp state as shown in FIG. 13. Thus, the function of amplification of overrun during release (FIG. 11) and the effect of generating reverse bending upon passing through the punch shoulder (FIG. 12) are not produced, resulting in a small wall warp improvement effect.

Figure 14:
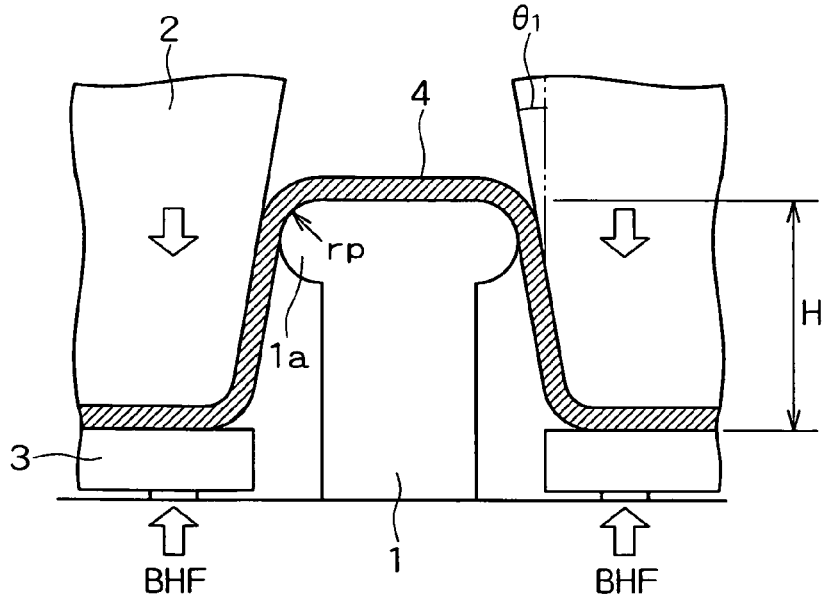
FIG. 14 is an explanatory diagram of the state in which a member having a vertical wall portion to be formed, inclined so as to widen downward is press formed.

On the other hand, as shown in FIG. 14, in the case where a member having a vertical wall portion inclined so that the vertical wall portion to be formed widens downward (in the diagram, θ1 denotes the angle of inclination of the vertical wall portion) is press formed, even when the blank holder 3 is caused to move upward together during release from the die set, the clearance between the punch shoulder portion and the die widens as the die 2 moves upward. Thus, the function of amplification of overrun does not sufficiently occur with approach to the material in the vicinity of the die shoulder, and the effects of the present invention may not be produced sufficiently. Namely, the wall warp is improved at the portion having a narrow clearance from the punch shoulder during release. Whereas, wall warp tends to be likely to occur at the portion having a wide clearance from the punch shoulder (vertical wall lower part) during release.

Thus, for solving the foregoing problem, the present inventors have further conducted an additional study with the aim of implementing a die set structure capable of satisfying the following requirements: (1) overrun and reverse bending deformation can be implemented only during forming; (2) overrun and reverse bending deformation can be implemented along the overall length of the vertical wall regardless of the angle of inclination (θ1 shown in FIG. 14) of the vertical wall, and other requirements.

As a result, it has been clarified as follows. A die set is configured to have a forming jig which moves in synchronism with a die while keeping the relative position to the die during forming, and forms the vertical wall portion of a metal sheet. For the forming jig, the clearance CL4 between the forming jig and the die in the vicinity of the die shoulder is set so as to be wider than the clearance CL3 between the forming jig and the die in the forming area other than the vicinity of the die shoulder (CL3<CL4). As a result, the foregoing disadvantage is resolved, and it is possible to further enhance the dimensional accuracy in press forming of the metal sheet.

Figure 15:
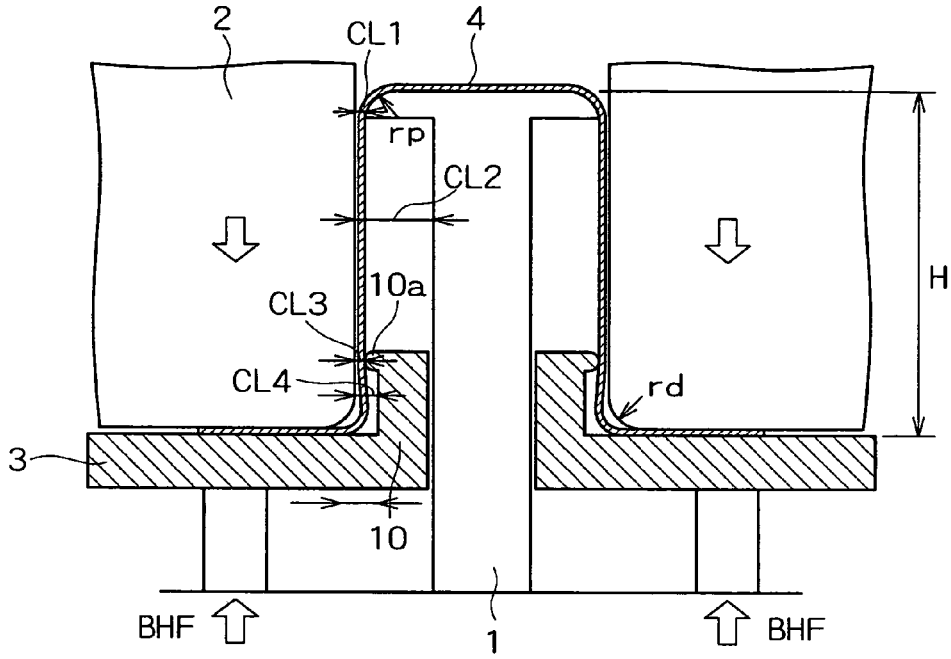
FIG. 15 is a schematic explanatory diagram showing one example of a configuration of a press forming die set of the present invention.

FIG. 15 is a schematic explanatory diagram showing one example of a configuration of a press forming die set of the present invention completed from the foregoing viewpoint. It is similar in basic configuration to FIG. 4, and the same reference numerals and characters are given to the corresponding parts, so that overlapping description is avoided. With this configuration, the forming jigs 10 for forming the vertical wall portions of the metal sheet 4 (press formed product) are provided one each on opposite inner sides (sides facing the punch 1) of the blank holders 3 in such a manner as to be each integral with its corresponding blank holder 3. Each forming jig 10 has a protrusion 10*a* for forming the metal sheet 4 from inside of the metal sheet 4 on its top end. Then, each forming jig 10 is configured to move in synchronism with the die 2 while keeping the relative position to the die 2 during forming, so that the clearance (CL3) between the forming jig (i.e., the protrusion 10*a*) and the die 2 is constant. Further, it is configured such that the clearance CL4 between the forming jig 10 and the die 2 in the vicinity of the die shoulder is set wider than the clearance CL3 (i.e., the clearance in the forming area other than the vicinity of the die shoulder). By adopting such a die set configuration, overrun and reverse bending deformation function are further achieved by the forming jigs 10 during press forming.

Figure 16:
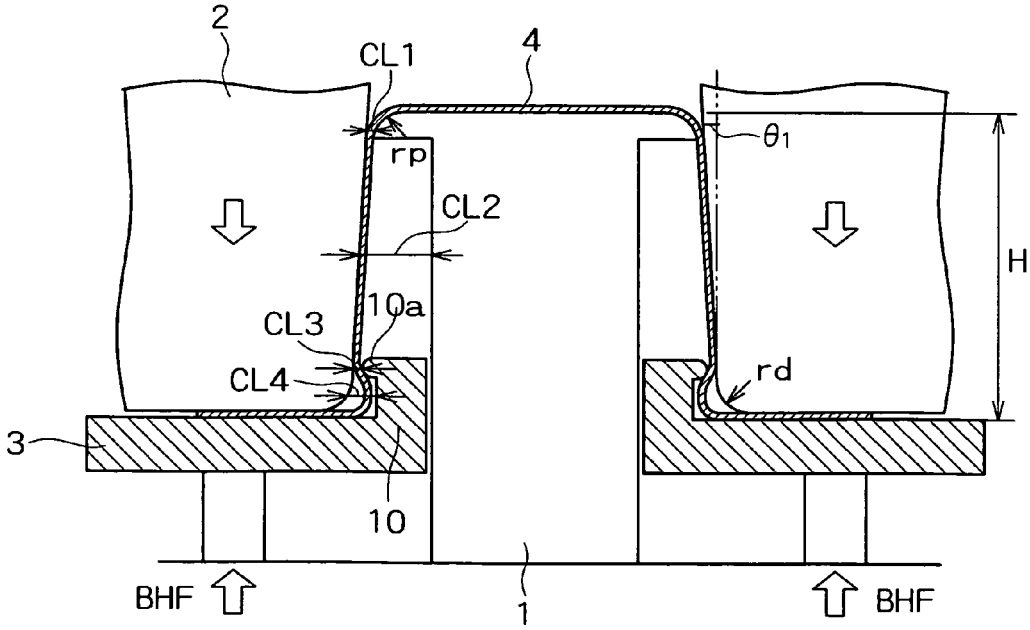
FIG. 16 is a schematic explanatory diagram showing another example of the configuration of the press forming die set of the present invention.

FIG. 16 is a schematic explanatory diagram showing another example of a configuration of a press forming die set in accordance with the present invention. This configuration is for the case where the present invention is applied to the press forming of a material with a vertical wall portion having an inclined angle. Other portions are equal to those of the die set configuration shown in FIG. 15. Also by adopting such a configuration, the foregoing effects of the present invention are achieved.

Figure 23:
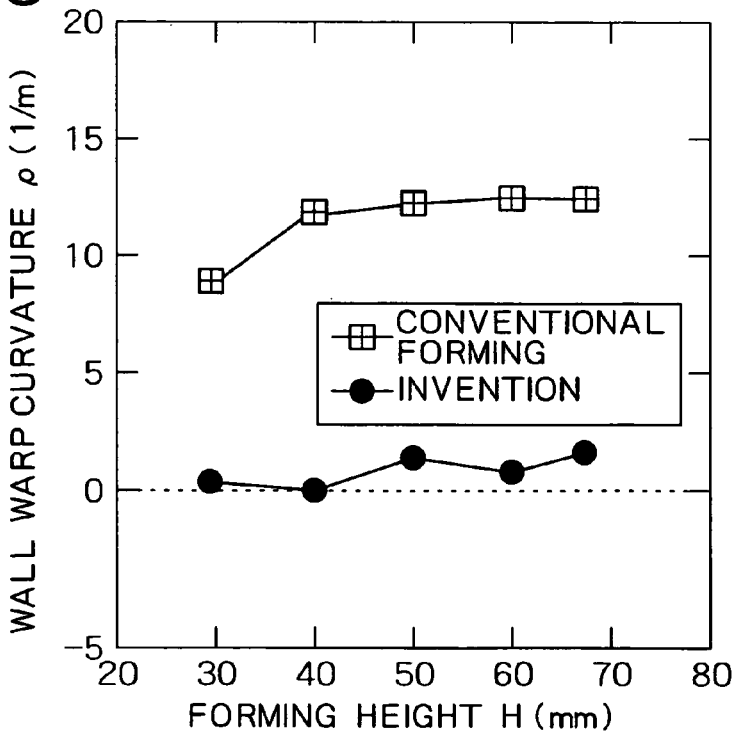
FIG. 23 is a graph showing the relationship between the forming height H and the wall warp curvature ρ.

Incidentally, the respective clearances CL3 and CL4 are preferably set so as to satisfy the following relationships of the expressions (3) and (4), respectively, for the same reason as that for the clearances CL1 and CL2 (in the expressions, t denotes the thickness). Namely, the respective clearances CL3 and CL4 accomplish the roles of (1) inducing overrun; (2) amplifying overrun; and (3) applying reverse bending, as with the clearances CL1 and CL2. Whereas, as apparent from FIG. 23, the expressions (1) and (2) are not affected by the forming height H. For this reason, even when the protrusion 10*a* shown in FIG. 15 is in the vicinity of the die shoulder, the configuration can be conceivably controlled by the same relationship of the expressions (1) and (2) [i.e., the expressions (3) and (4)]for the clearances as with the punch shoulder 10*a* of FIG. 10.

$$0.8\times t \leqq CL3 \leqq 1.2\times t \quad (3)$$

$$CL4 \geqq CL3+t \quad (4)$$

Therefore, when the die set structures of FIGS. 15 and 16 are adopted, the effects of the present invention are achieved only by defining the clearances CL3 and CL4 so as to meet the proper relationship, without accurately defining the relationship of CL1 and CL2. The clearances CL1 and CL2 may be certainly defined so as to satisfy the relationship of the expressions (1) and (2) even when such a configuration is adopted.

Figure 17A:
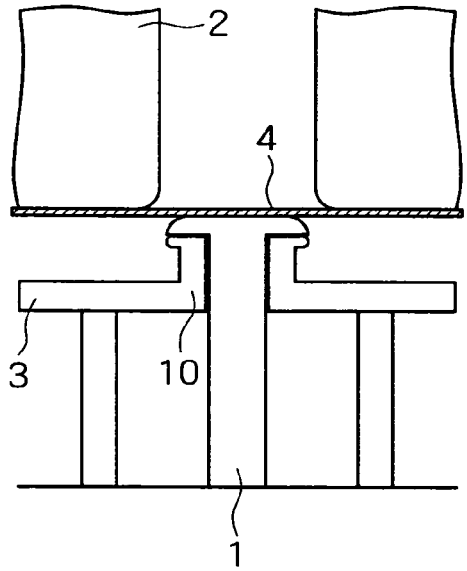
FIGS. 17A to 17C are schematic explanatory diagrams showing the procedure for forming a metal sheet when a die set including forming jigs 10 is used.

The procedure for forming a metal sheet when using a die set having forming jigs will be described by reference to drawings. First, at the time of start of forming, as shown in FIG. 17A, the metal sheet 4 is not being interposed between the die 2 and the blank holder 3 by the presence of the forming jigs 10, but a prescribed space is present between the blank holder 3 and the metal sheet 4. Then, forming of the metal sheet 4 is started by the die 2, so that the metal sheet 4 undergoes bend forming. At this step, the blank holder 3 still does not operate [FIG. 17B]. Subsequently, the die 2 is caused to move downward with the metal sheet 4 interposed between the die 2 and the blank holder 3 (the blank holder 3 also follows the movement, and moves downward), thereby to carry out forming of the metal sheet 4 [FIG. 17C].

Figure 17B:
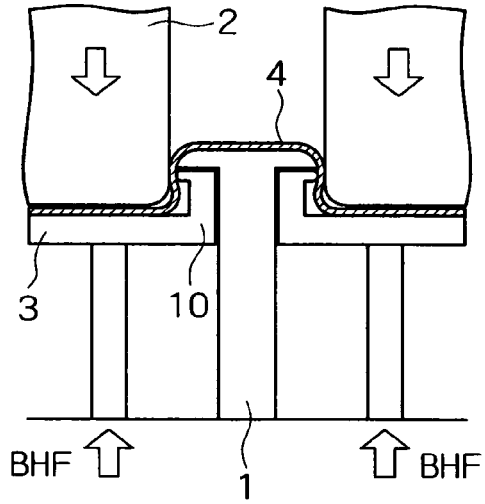
Figure 17C:
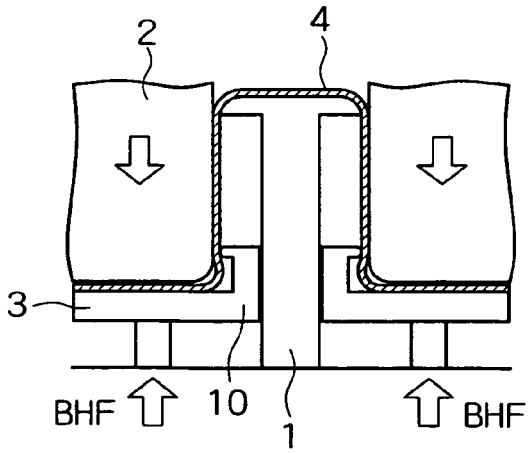

With the die sets shown in FIGS. 15 and 16, provision of the forming jigs 10 effectively generates overrun and reverse bending to the metal sheet 4 during forming. As shown in FIGS. 17A to 17C, upon starting of forming using such a die set, the same function as that in the state where, using a die set not including a forming jig 10, forming has been started with the blank holder 3 waiting is achieved (FIGS. 7 and 8), so that the effect of reducing the flange spring angle is also produced.

Figure 18:
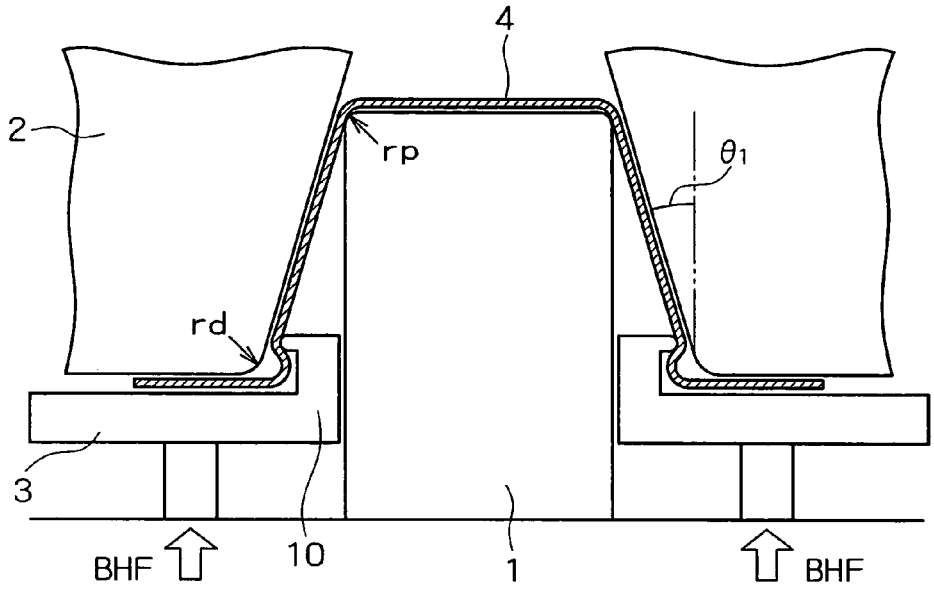
FIG. 18 is an explanatory diagram showing a modified example of a die set provided with only clearances CL3 and CL4.

Incidentally, when the clearances CL3 and CL4 are properly defined, the effects of the present invention are achieved even if the clearances CL1 and CL2 are not accurately defined. For this reason, it is also possible to achieve such a die set design in which only the clearances CL3 and CL4 are provided, if required. A modified example of a die set configured from such a viewpoint is shown in FIG. 18. This die set is intended for manufacturing a formed product having an incline vertical wall portion. The punch 1 is not provided with a convex portion 1*a* on its top, and is formed of a vertical wall. Further, the forming surface of the die 2 is formed in an inclined surface because the forming jig inserts around the lower part of the punch 1. Then, by properly setting the clearances CL3 and CL4 between the forming jig 10 and the die 2, a vertical wall portion having an angle of inclination of θ1 is formed by the action of the forming jig 10 and the die 2. The effects of the present invention are also achieved by the die set of such a configuration.

Below, the functions and the effects of the present invention will be more specifically shown by way of examples. However, the following examples should not be construed as limiting the scope of the invention. The present invention can be practiced with appropriate modification within a scope not departing from the gist described above or later, any of which is included in the technical range of the present invention.

EXAMPLES

Example 1

As for the dimensional accuracy when a hat channel member was formed with press forming by means of the die set (rp=5 mm) of the present invention shown in FIG. 4 using a 980 MPa class cold rolled sheet steel (thickness t: 1.2 mm), the clearance CL2 was changed, and the effects thereof were examined. At this step, as the clearance CL1, CL1=t, which enabled the spring angle of the flange surface to be controlled to 0°, was adopted. Whereas, the clearance CL2 was varied to 6 values of (1) CL1+0 mm, (2) CL1+0.5 mm, (3) CL1+1.7 mm, (4) CL1+2.8 mm, (5) CL1+3.9 mm, and (6) CL1+5 mm. Further, the other conditions (die radius rd, forming height H, blank holding force, and the like) were set at the same values as described above. The flange spring angles θ in the respective cases (1) to (6) were as follows.

(Flange Spring Angle θ)

(1) 48°, (2) 26.9°, (3) 4.3°, (4) −1.3°, (5) −1.0°, (6) −1.7°

Figure 19:
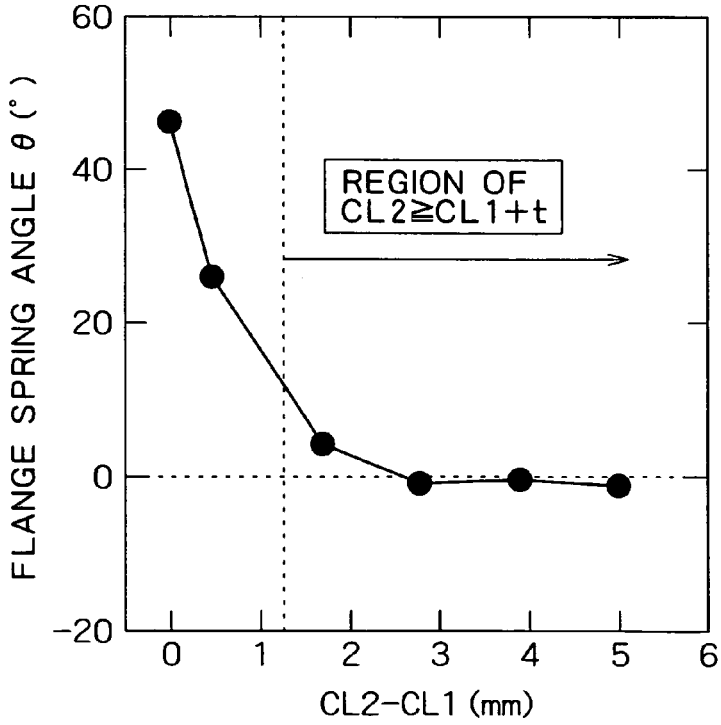
FIG. 19 is a graph showing the relationship between the difference between the clearances CL1 and CL2 and the flange spring angle θ when forming was carried out using a 980 MPa class cold rolled sheet steel.
Figure 20A:
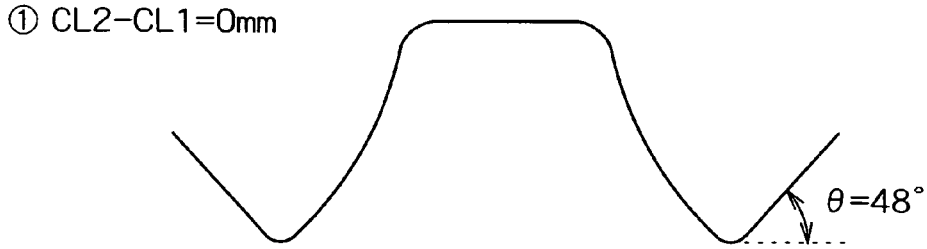
FIGS. 20A and 20B are explanatory diagrams showing the product cross sectional shape for conventional forming and the product cross sectional shape when CL2−CL1=5 mm, respectively, for comparison.
Figure 20B:
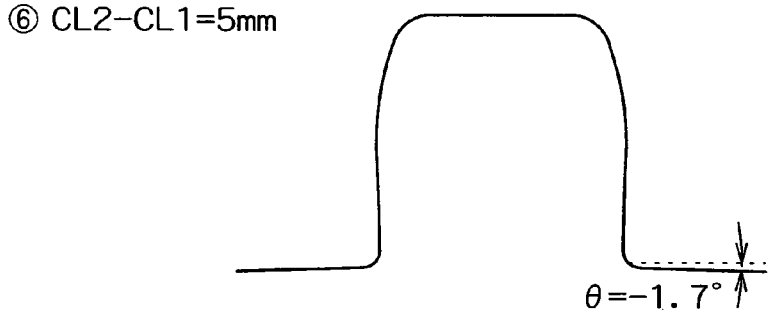

The relationship between the difference between the clearances CL2 and CL1 (CL2−CL1: mm) and the flange spring angle θ is shown in FIG. 19. The product cross sectional shape for conventional forming (CL2−CL1=0 mm) and the product cross sectional shape when CL2−CL1=5 mm are shown for comparison in FIGS. 20A and 20B, respectively. As apparent from these results, when CL2−CL1≧t (i.e., CL2≧CL1+t), the flange spring angle θ is almost stable in the vicinity of 0°.

The same examination was carried out using a 590 MPa class cold rolled sheet steel (thickness t: 1.2 mm) in the same manner as described above. As a result, the flange spring angles θ in the respective cases (1) to (6) were as follows.

(Flange Spring Angle θ)

(1) 25.5°, (2) 7.5°, (3) −0.6°, (4) −0.7°, (5) 0.0°, (6) −0.4°

Figure 21:
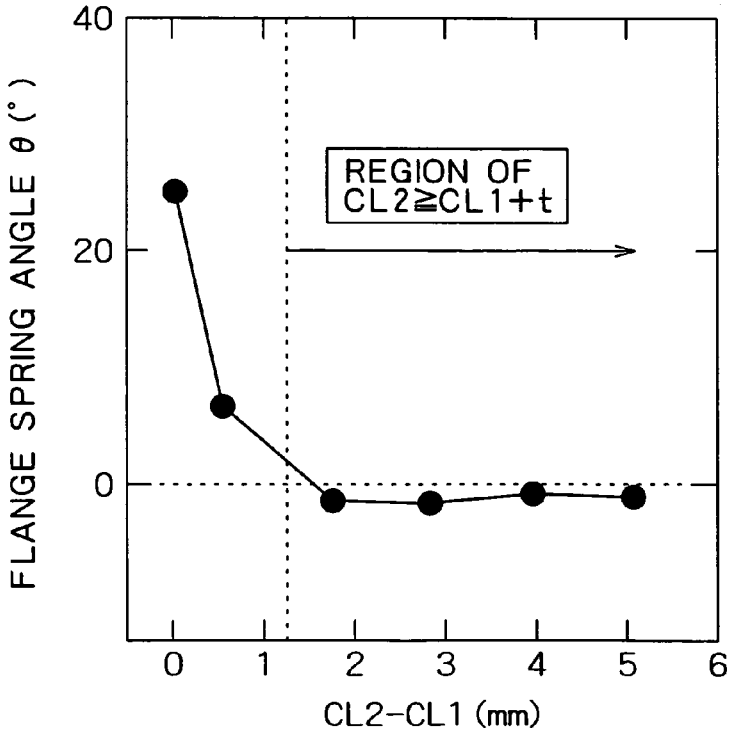
FIG. 21 is a graph showing the relationship between the difference between the clearances CL1 and CL2 and the flange spring angle θ when forming was carried out using a 590 MPa class cold rolled sheet steel.

The relationship between the difference between the clearances CL2 and CL1 (CL2−CL1: mm) and the flange spring angle θ at this step is shown in FIG. 21, indicating that almost the same tendency as with FIG. 19 is observable.

Incidentally, it is conceivable that the dimensional accuracy is dependent upon some other influence factors in the die set [forming height H (FIG. 10), die radius rd, punch top part shape, and the like]. The present inventors conducted a study on these factors. As a result, it has been shown that these factors do not affect the effects of the present invention so much. Then, the results of the study will be shown.

As for the dimensional accuracy when a hat channel member was formed with press forming by means of the die set of the present invention shown in FIG. 4 using a 980 MPa class cold rolled sheet steel (thickness t: 1.2 mm), the forming height H was changed, and the effects thereof were examined. The forming height H at this step was varied within a range of (1) 30 mm, (2) 40 mm, (3) 50 mm, (4) 60 mm, and (5) 67 mm, by changing the bottom dead center of the die.

As for the clearances CL1 and CL2, under the conditions of CL1=t (mm) and CL2=CL1+5 (mm), which enabled the implementation of flange spring angle θ≈0° in FIG. 19, the effect of the forming height H on the flange spring angle θ was examined. Further, under the conditions of CL1=t+0.2 (mm) and CL2=CL1+5 (mm), which enabled the implementation of wall warp ≈0 (mm) in FIG. 6B, the effect of the forming height H on the wall warp was examined.

Figure 22:
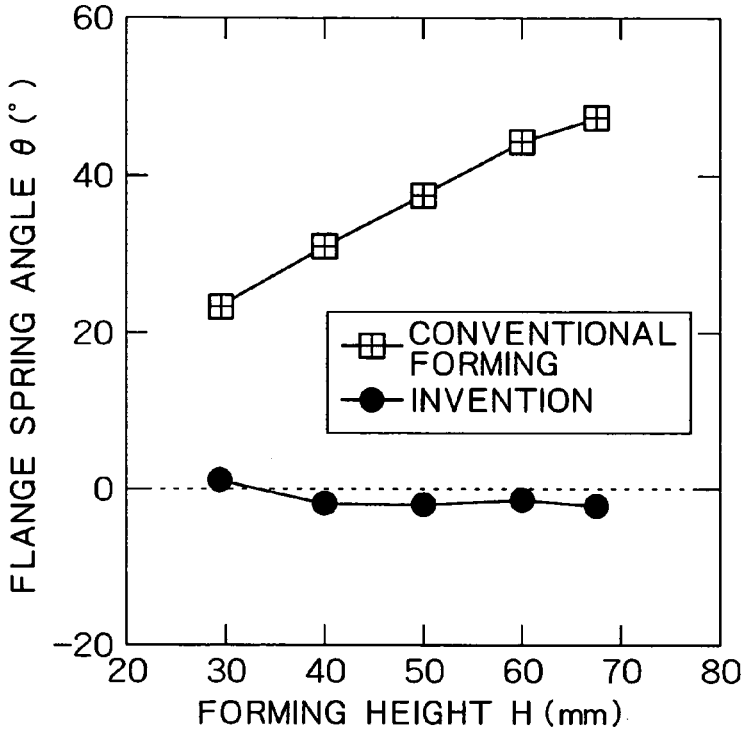
FIG. 22 is a graph showing the relationship between the forming height H and the flange spring angle θ.

The relationship between the forming height H and the flange spring angle θ is shown in FIG. 22. The relationship between the forming height H and the wall warp curvature ρ is shown FIG. 23. Incidentally, the wall warp curvature ρ is the value expressed as 1/d where d denotes the warp radius. As apparent from these results, the amount of dimensional defect is large for conventional forming. Whereas, for the present invention, the defect amount is small and no effect of the forming height H arises at all.

As for the dimensional accuracy when a hat channel member was formed with press forming by means of the die set of the present invention shown in FIG. 4 using a 980 MPa class cold rolled sheet steel (thickness t: 1.2 mm), the die radius rd was changed, and the effects thereof were examined. The die radius rd at this step was varied within a range of (1) 5 mm, (2) 10 mm, and (3) 15 mm (forming height H was 67 mm).

Figure 24:
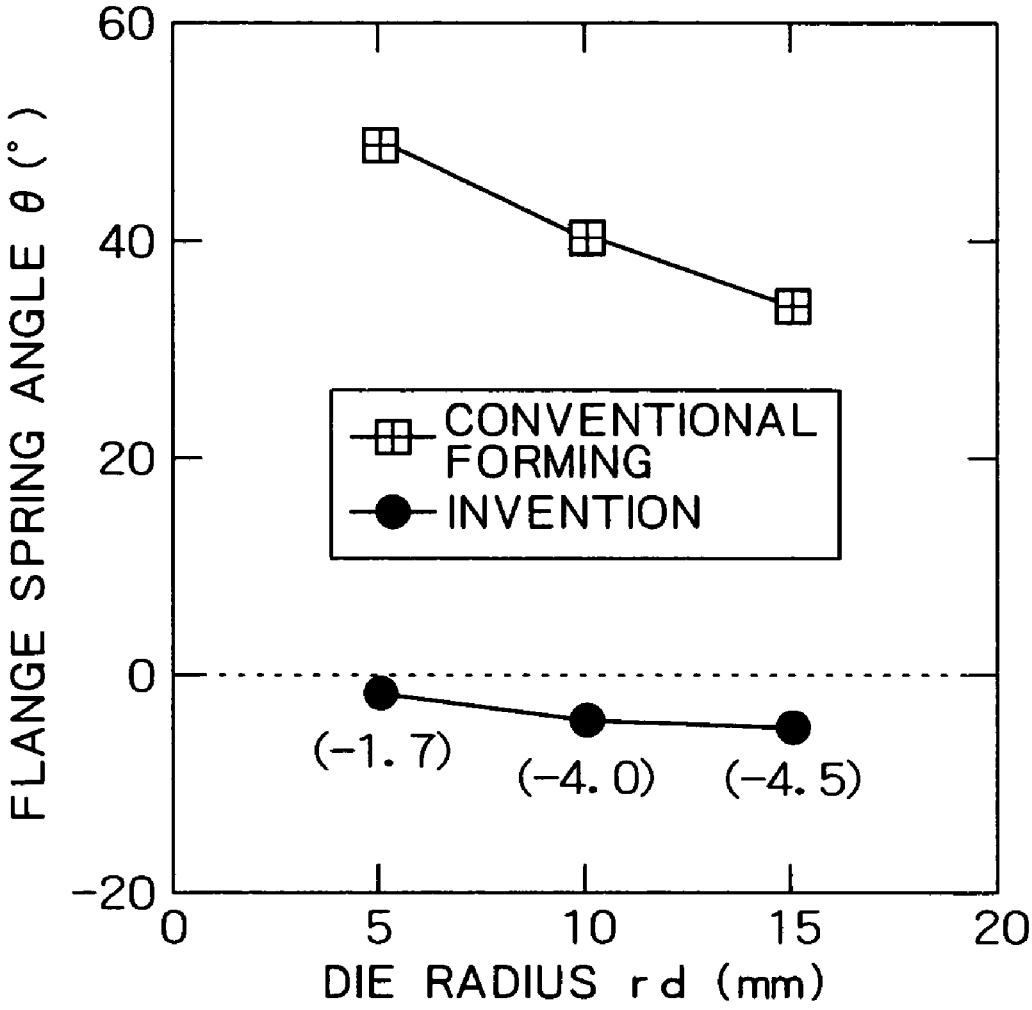
FIG. 24 is a graph showing the relationship between the die radius rd and the flange spring angle θ.

The relationship between the die radius rd and the flange spring angle θ is shown in FIG. 24, indicating as follows. Even when the die radius rd is increased up to 15 mm, the effects of the present invention can be kept, and flange spring angle θ≈0 is achieved. In contrast, when a conventional die set has been used (conventional forming), the die radius rd largely affects the flange spring angle θ. Namely, it is indicated that use of the die set of the present invention eliminates the necessity of controlling the die radius rd within a narrow range.

As described above, the shape of the top part of the punch has no particular restriction so long as the relationship of the clearances CL1 and CL2 defined in the present invention is satisfied. As for the dimensional accuracy (flange spring angle θ) when a hat channel member was formed with press forming by means of the punches of various top part shapes shown in FIGS. 4 and 5 using a 440 MPa class cold rolled sheet steel (thickness t: 1.2 mm), the effects of the top part shapes of the punches on the dimensional accuracy (flange spring angle θ) were examined. The other conditions at this step were set as follows.

(Press Forming Conditions)

Clearance: CL1=t (mm), CL2=CL1+5 (mm)

Die radius rd: 5 mm

Punch shoulder radius rp: 5 mm

Forming height H (FIG. 10): 67 mm

Blank size: width 250 mm, depth 40 mm

Blank holding force (BHF): 10 KN

Figure 25:
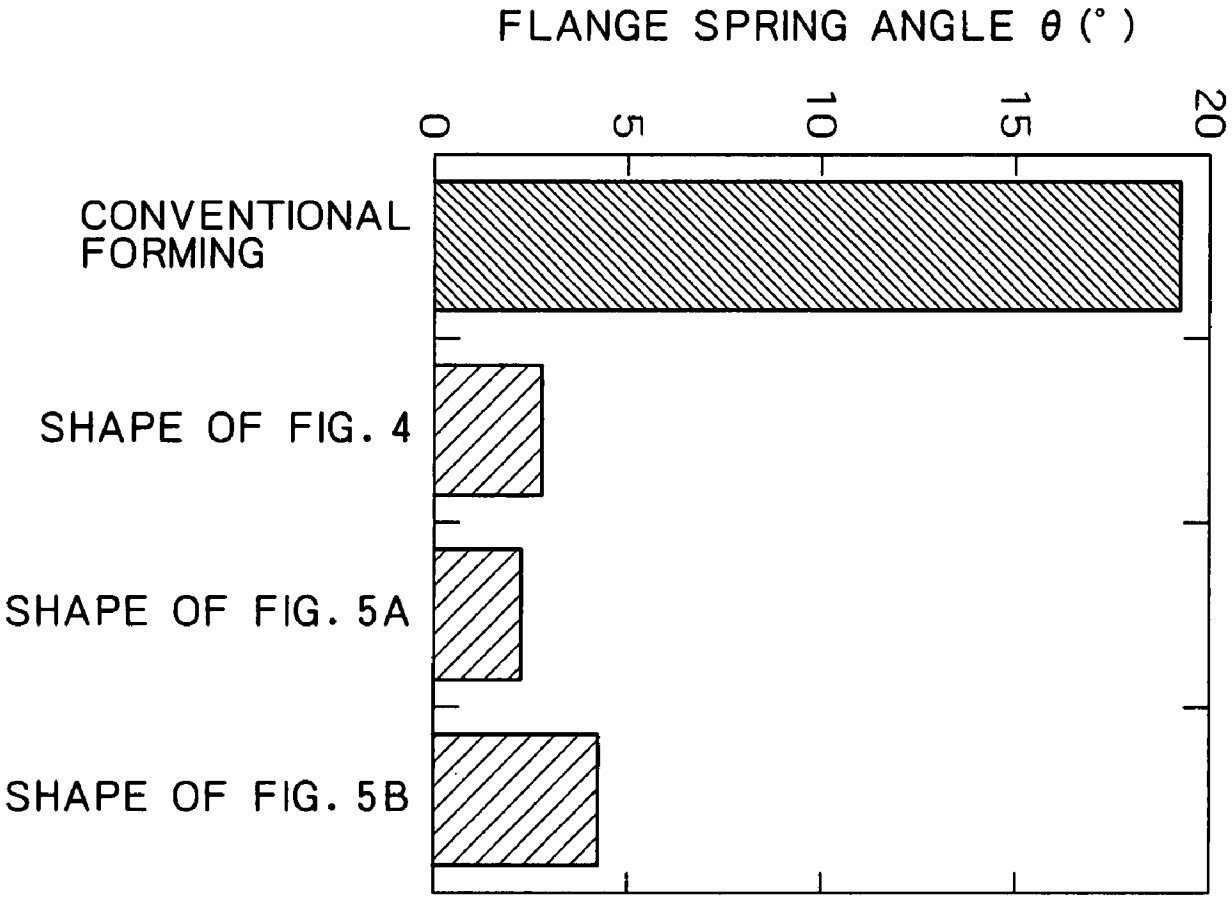
FIG. 25 is a graph showing the results of the examination on the effects inflicted upon the flange spring angle θ by the shape of a punch.

The results are shown for comparison with conventional forming in FIG. 25. As apparent from the results, a difference is slightly caused according to the shape of the top part of the punch. However, with any shape shown in FIGS. 4 and 5, the effects of the present invention are sufficiently produced. However, when the length along the direction of axis in the convex portion of the top part of the punch (i.e., the length of the portion corresponding to the portion formed at the initial stage of forming) [FIG. 5B] is elongated, the effects of the present invention are affected to be decreased. Therefore, it is necessary to set the length at a proper length.

The proper clearances specified above were set [CL1=t (mm), CL2=CL1+5 (mm)]. A 590 MPa class hot dip zinc plated sheet steel which had not been used above (thickness t: 1.4 mm) was subjected to press forming to manufacture a hat channel member (the other conditions are the same as described above) As a result, it has been shown that a hat channel member with favorable dimensional accuracy is formed.

Example 2

As for the dimensional accuracy when a hat channel member was formed with press forming by means of the die set of the present invention shown in FIG. 4 (rp=5 mm) using a 780 MPa class cold rolled sheet steel (thickness t: 1.2 mm), the wait height ΔH of the blank holder (FIG. 7) was varied (ΔH=0 mm and ΔH=20 mm), and the effects thereof were examined. The press forming conditions at this step were as follows.

(Press Forming Conditions)

Clearance: CL1=t+0.2 (mm), CL2=CL1+5 (mm)

Die radius rd: 5 mm

Punch shoulder radius rp: 5 mm

Forming height H (FIG. 10): 67 mm

Blank size: width 250 mm, depth 40 mm

Blank holding force (BHF): 10 KN

Wait height ΔH: 0 mm (no wait), 20 mm

Figure 26:
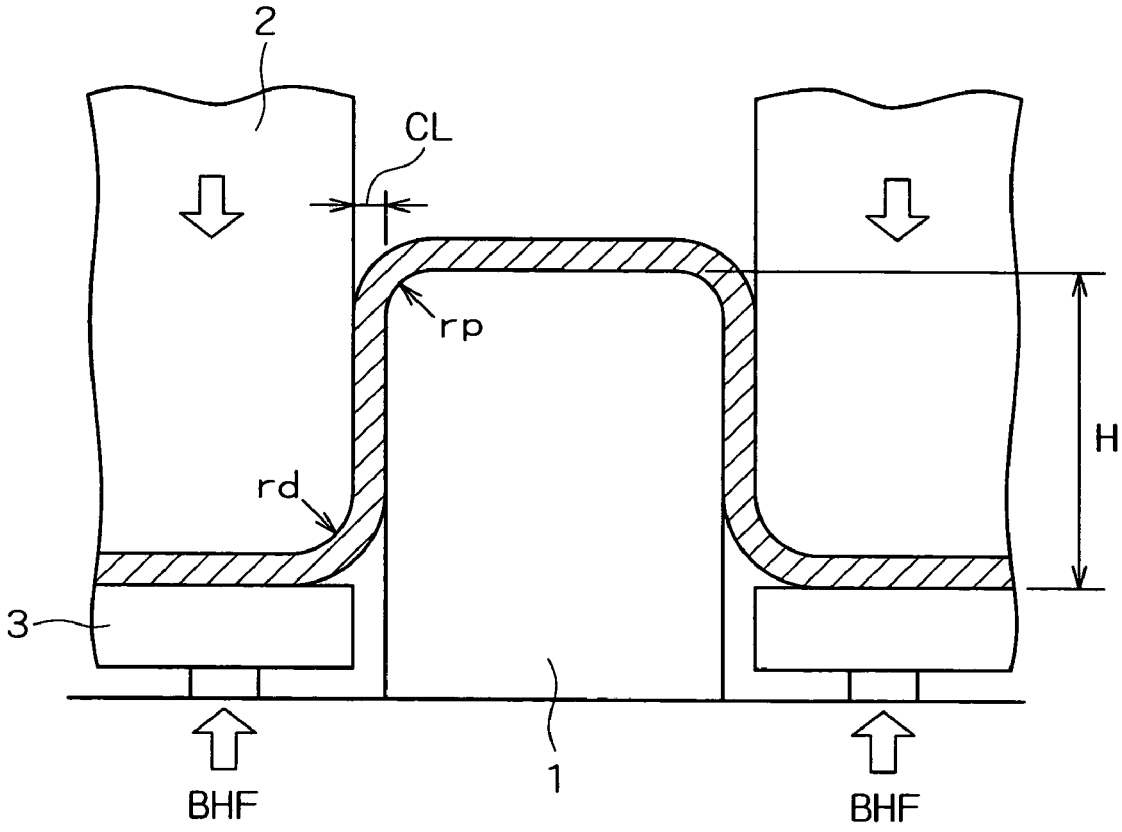
FIG. 26 is a schematic explanatory diagram showing one example of a configuration of a conventional press forming die set.

At this step, an examination was also carried out on the dimensional accuracy when a hat channel member was formed by a conventional procedure (see, FIGS. 9A and 9B, and 10) by means of a conventional die set (the one having no convex portion 1*a* formed on the top of the punch) shown in FIG. 26 (the press forming conditions were the same as described above except that the clearance CL=1.5 mm). Further, in any case, the blank holder 3 was caused to move upward together during release from the die set.

Figure 27A:
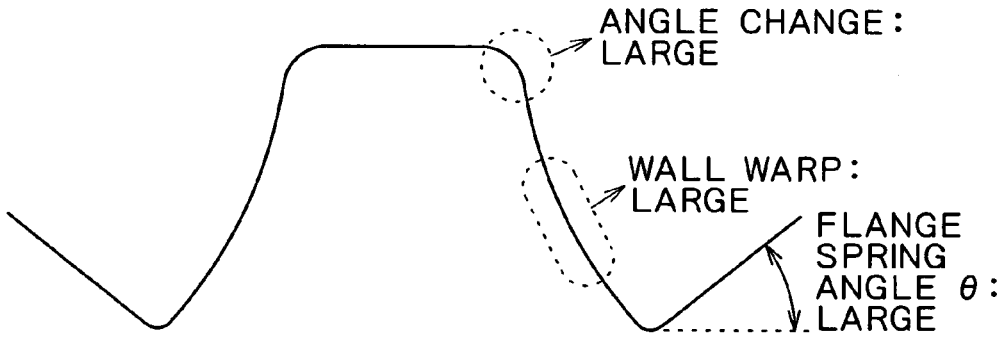
FIGS. 27A to 27C are schematic explanatory diagrams showing the product cross sectional shapes when press forming was carried out by means of respective die sets.
Figure 27B:
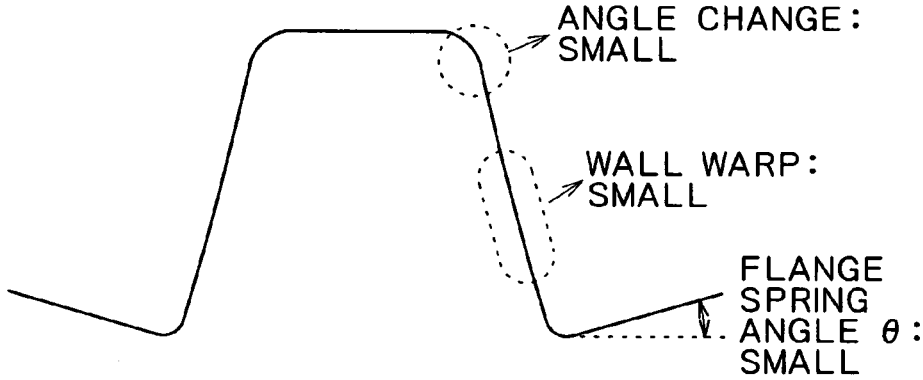
Figure 27C:
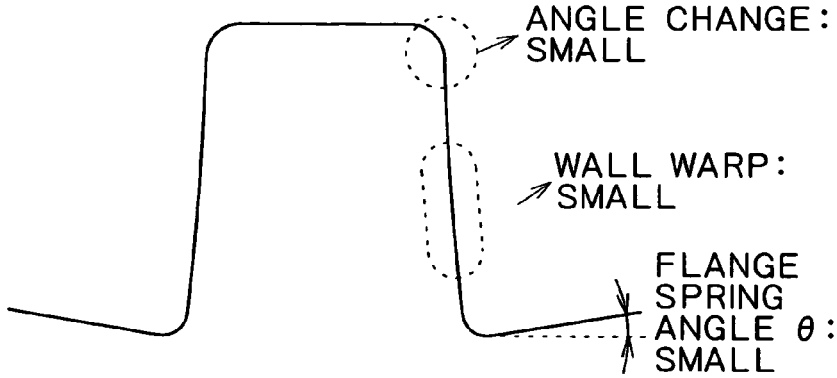

The cross sectional shapes of the products press formed by respective die sets are shown in FIGS. 27A to 27 C. Out of these, FIG. 27A shows the shape when the product has been formed using a conventional die set, indicating that wall warp and angle change mostly remains, and the flange spring angle θ have been also increased. In contrast, FIG. 27B shows the cross sectional shape of the product when using the die set of the present invention (wait height ΔH=0 mm), indicating that the angle change is large, but the wall warp and the flange spring angle θ have been reduced. Further, FIG. 27C shows the one in the case where using the die set of the present invention, forming was started with the blank holder waiting (wait height ΔH=20 mm), indicating that both the wall warp and the angle change have been reduced, and the flange spring angle θ has been also further reduced.

Example 3

The dimensional accuracy when each hat channel member was formed with press forming by means of the die set shown in FIG. 4 and the die set (the one including forming jigs 10) shown in FIG. 15 using a 780 MPa class cold rolled sheet steel (thickness t: 1.2 mm) was examined for the following respective cases (A) and (B):

(A) The case where the blank holder is caused to move upward together during release from the die set; and (B) The case where the blank holder is locked at the bottom dead center during release from the die set.

The common press forming conditions at this step were as follows.

(Press Forming Conditions)

Die radius rd: 5 mm

Punch shoulder radius rp: 5 mm

Forming height H (FIGS. 10 and 15): 67 mm

Blank size: width 250 mm, depth 40 mm

Blank holding force (BHF): 10 KN

The clearances CL1 and CL2 of the die set shown in FIG. 4 were set at CL1=1.2 mm (=thickness) and CL2=CL1+5 mm, respectively. The clearances CL1 to CL4 of the die set shown in FIG. 15 were set at CL1=1.2 mm (thickness), CL2=15 mm, CL3=1.2 mm (thickness), and CL4=CL3+3 mm, respectively. Further, in the die set shown in FIG. 15, the height from the blank holder top surface to the protrusion 10*a* was set at 11 mm, and the shoulder radius of the protrusion 10*a* was set at 3 mm.

At this step, an examination was also carried out on the dimensional accuracy when a hat channel member was formed by means of the conventional die set shown in FIG. 26 in each of the cases (A) and (B) (the press forming conditions were the same as described above except that the clearance CL=1.5 mm).

As a result, when forming was carried out by means of a conventional die set, in any of the cases (A) and (B), the wall warp and the angle change mostly remained, and the flange spring angle θ was also increased [see, FIG. 27A].

Figure 28:
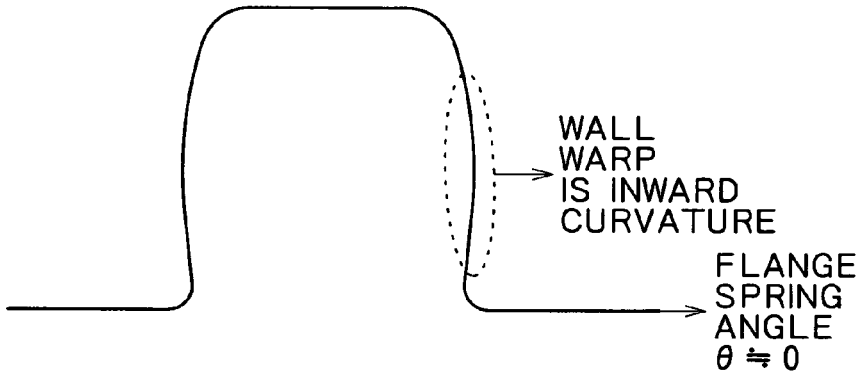
FIG. 28 is an explanatory diagram showing the cross sectional shape of a product of which the wall warp has been improved by means of the die set of the present invention.

In contrast, when forming was carried out by means of the die set shown in FIG. 4 under the conditions of the case (A), a formed product of which the wall warp had been improved as shown in cross section in FIG. 28 was obtained. Whereas, when forming was carried out under the conditions of the case (B), the wall warp occurred, resulting in the shape shown in FIG. 27A. Whereas, when the die set shown in FIG. 15 was used, even in any of the cases (A) and (B), the wall warp was improved, so that the formed product as shown in FIG. 28 was obtained.

Example 4

An examination was carried out on the dimensional accuracy when each hat channel member was formed with press forming by means of the die set shown in FIG. 14 and the die set (the one with a vertical wall portion having an angle of inclination) shown in FIG. 16 using a 780 MPa class cold rolled sheet steel (thickness t: 1.2 mm).

The common press forming conditions at this step were as follows.

(Press Forming Conditions)

Die radius rd: 5 mm

Punch shoulder radius rp: 5 mm

Angle of inclination θ1: 3°

Forming height H (FIGS. 14 and 16): 67 mm

Blank size: width 250 mm, depth 40 mm

Blank holding force (BHF): 10 KN

The clearances CL1 and CL2 of the die set shown in FIG. 14 were set at CL1=1.2 mm (=thickness) and CL2 (the narrowest portion immediately under the top part of the punch)=CL1+5 mm, respectively. Whereas, the clearances CL1 to CL4 of the die set shown in FIG. 16 were set at CL1=1.2 mm (thickness), CL2 (the narrowest portion immediately under the top part of the punch)=15 mm, CL3=1.2 mm (thickness), and CL4=CL3+3 mm, respectively. Further, in the die set shown in FIG. 16, the height from the blank holder top surface to the protrusion 10*a* was set at 11 mm, and the shoulder radius of the protrusion 10*a* was set at 3 mm.

Figure 29:
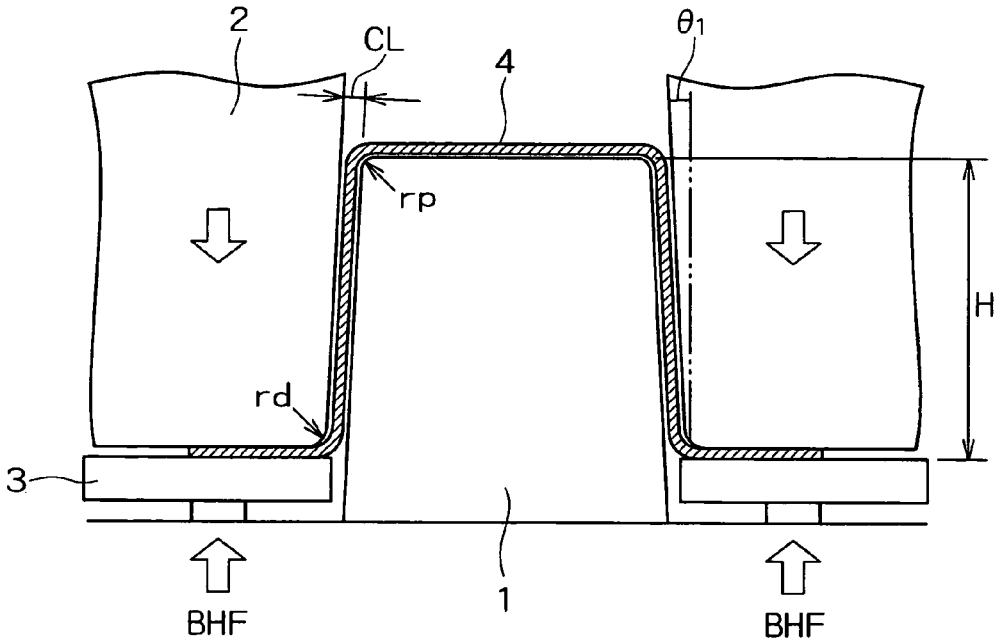
FIG. 29 is a schematic explanatory diagram showing a conventional die set when a product with an inclined vertical wall portion is formed.

At this step, an examination was also carried out on the dimensional accuracy when a hat channel member was formed by means of a conventional die set (the one with a vertical wall portion having an angle of inclination θ1 of 3°) shown in FIG. 29 (the press forming conditions were the same as described above except that the clearance CL=1.5 mm). Further, the blank holder 3 was caused to move upward together during release from the die set.

Figure 30A:
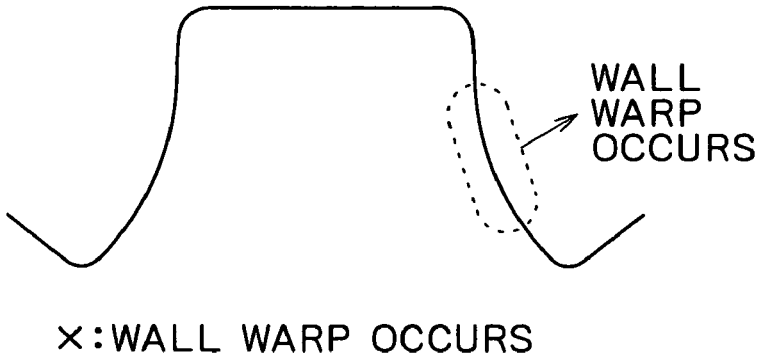
FIGS. 30A to 30C are schematic explanatory diagrams showing the product cross sectional shapes when press forming was carried out by means of respective die sets.
Figure 30B:
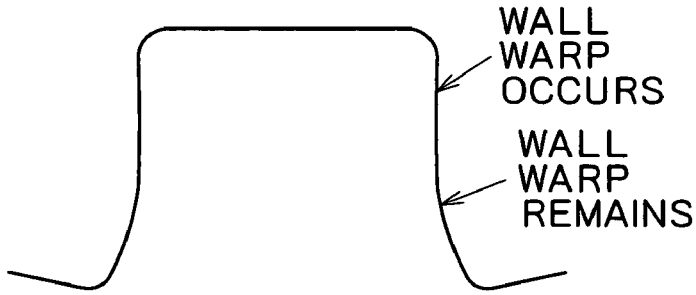
Figure 30C:
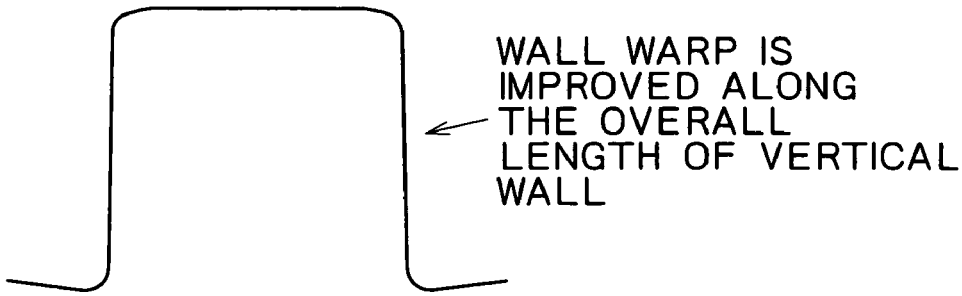

The cross sectional shapes of the products press formed by respective die sets are shown in FIGS. 30A to 30C. Out of these, FIG. 30A shows the shape when the product has been formed using a conventional die set, indicating that the wall warp and the angle change mostly remains, and that the flange spring angle θ has been also increased. In contrast, FIG. 30B shows the cross sectional shape of the product when using the die set shown in FIG. 14, indicating that the wall warp partially remains, but has been largely improved. Further, FIG. 30C shows the cross sectional shape of the product when using the die set shown in FIG. 16, indicating that the wall warp has been improved along the overall length of the vertical wall.

These results are for the case where the blank holder was caused to move upward together during release from the die set. It has been confirmed as follows. When the die set shown in FIG. 16 is used, the same results [FIG. 30C] are obtainable even when the blank holder is locked at the bottom dead center during release from the die set.

What is claimed is:

1. A die set for press forming a metal sheet, comprising:

a punch; and a die, wherein a clearance CL2 between the punch and the die corresponding to a site to be formed immediately after an initial stage of press forming and a clearance CL1 between the punch and the die corresponding to a site to be formed in the initial stage of press forming are set so as to satisfy the following expressions (1) and (2), respectively:

$$0.8\times t \leqq CL1 \leqq 1.2\times t \quad (1)$$

$$CL2 \geqq CL1+t \quad (2)$$

where t denotes a thickness of the metal sheet to be formed, wherein a convex portion extending toward the die is formed at a top part area of the punch corresponding to a site to be formed at the initial stage of forming.

2. The die set for press forming a metal sheet according to claim 1, further comprising a forming jig which moves in synchronism with the die while keeping a relative position to the die during forming, and forms a vertical wall portion of the metal sheet, wherein in the forming jig, a clearance CL4 between the forming jig and the die in the vicinity of a die shoulder of the die is set so as to be wider than a clearance CL3 between the forming jig and the die in a forming area other than the vicinity of the die shoulder of the die.

3. A die set for press forming a metal sheet, comprising:

a punch;

a die, wherein a clearance CL2 between the punch and the die corresponding to a site to be formed immediately after an initial stage of press forming and a clearance CL1 between the punch and the die corresponding to a site to be formed in the initial stage of press forming are set so as to satisfy the following expressions (1) and (2), respectively:

$$0.8\times t \leqq CL1 \leqq 1.2\times t \quad (1)$$

$$CL2 \geqq CL1+t \quad (2)$$

where t denotes a thickness of the metal sheet to be formed; and a forming jig which moves in synchronism with the die while keeping a relative position to the die during forming, and forms a vertical wall portion of the metal sheet, wherein in the forming jig, a clearance CL4 between the forming jig and the die in the vicinity of a die shoulder of the die is set so as to be wider than a clearance CL3 between the forming jig and the die in a forming area other than the vicinity of the die shoulder of the die, wherein the clearances CL3 and CL4 are set so as to satisfy the following expressions (3) and (4), respectively:

$$0.8\times t \leqq CL3 \leqq 1.2\times t \quad (3)$$

$$CL4 \geqq CL3+t \quad (4)$$

where t denotes the thickness of the metal sheet to be formed.

4. A press forming method of a metal sheet using a die set comprising a punch and a die, the method comprising the steps of:

introducing the punch into the die in an initial stage of press forming;

continuing to introduce the punch into the die after the initial stage of press forming; and providing a clearance CL2 between the die and a portion of the punch which enters the die immediately after an initial stage of press forming, and providing a clearance CL1 between the die and a portion of the punch which enters the die in the initial stage of press forming, wherein CL1 and CL2 are set so as to satisfy the following expressions (1) and (2), respectively:

$$0.8\times t \leqq CL1 \leqq 1.2\times t \quad (1)$$

$$CL2 \geqq CL1+t \quad (2)$$

where t denotes a thickness of the metal sheet to be formed.

5. A die set for press forming a metal sheet, and manufacturing a formed product, comprising:

a punch;

a die; and a forming jig mounted to move in synchronism with the die while keeping a relative position to the die during forming, wherein in the forming jig, a clearance CL4 between the forming jig and the die in the vicinity of a die shoulder of the die is set so as to be wider than a clearance CL3 between the forming jig and the die in a forming area other than the vicinity of the die shoulder of the die.

6. A die set for press forming a metal sheet, and manufacturing a formed product having an inclined vertical wall portion, comprising:

a punch;

a die; and a forming jig which moves in synchronism with the die while keeping a relative position to the die during forming, and forms the inclined vertical wall portion of the metal sheet, wherein in the forming jig, a clearance CL4 between the forming jig and the die in the vicinity of a die shoulder of the die is set so as to be wider than a clearance CL3 between the forming jig and the die in a forming area other than the vicinity of the die shoulder of the die, wherein the clearances CL3 and CL4 are set so as to satisfy the following expressions (3) and (4), respectively:

$$0.8\times t \leqq CL3 \leqq 1.2\times t \quad (3)$$

$$CL4 \geqq CL3+t \quad (4)$$

where t denotes the thickness of the metal sheet to be formed.

7. A press forming method of a metal sheet, comprising press forming the metal sheet using the die set for press forming according to claim 5.

8. The die set for press forming a metal sheet according to claim 5, wherein the die has an inclined vertical wall to form an inclined vertical wall portion of the metal sheet.

* * * * *

UNITED STATES PATENT AND TRADEMARK OFFICE

CERTIFICATE OF CORRECTION

PATENT NO. : 7,117,708 B2
APPLICATION NO. : 10/790755
DATED : October 10, 2006
INVENTOR(S) : Yamano et al.

It is certified that error appears in the above-identified patent and that said Letters Patent is hereby corrected as shown below:

On the title page, Item (73), the Assignee Information is incorrect. Item (73) should read:

-- (73) Assignee: Kabushiki Kaisha Kobe Seiko Sho
(Kobe Steel, Ltd.) Kobe (JP)--

Signed and Sealed this

Twenty-sixth Day of December, 2006

JON W. DUDAS
*Director of the United States Patent and Trademark Office*